US009268254B2

(12) United States Patent
Monde et al.

(10) Patent No.: US 9,268,254 B2
(45) Date of Patent: Feb. 23, 2016

(54) IMAGE FORMING APPARATUS

(75) Inventors: Masafumi Monde, Yokohama (JP); Toshikazu Tsuchiya, Susono (JP); Hidetoshi Hanamoto, Mishima (JP); Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 13/991,952

(22) PCT Filed: Mar. 2, 2012

(86) PCT No.: PCT/JP2012/056050

§ 371 (c)(1),
(2), (4) Date: Jun. 6, 2013

(87) PCT Pub. No.: WO2012/118234

PCT Pub. Date: Sep. 7, 2012

(65) Prior Publication Data

US 2013/0266330 A1 Oct. 10, 2013

(30) Foreign Application Priority Data

Mar. 2, 2011 (JP) ..... 2011-045111
Mar. 2, 2011 (JP) ..... 2011-045112

(51) Int. Cl.
*G03G 15/08* (2006.01)

(52) U.S. Cl.
CPC ..... *G03G 15/0822* (2013.01); *G03G 15/086* (2013.01); *G03G 15/0856* (2013.01); *G03G 15/0875* (2013.01); *G03G 2215/0888* (2013.01)

(58) Field of Classification Search
CPC ..... G03G 15/0822; G03G 15/0875; G03G 2215/0888; G03G 15/086
USPC ..... 399/27
See application file for complete search history.

(56) References Cited

U.S. PATENT DOCUMENTS 5,287,151 A * 2/1994 Sugiyama ..... 399/258
5,587,770 A 12/1996 Jo et al.
6,463,225 B1 10/2002 Abe et al.

(Continued)

FOREIGN PATENT DOCUMENTS

EP 1083464 A2 3/2001
EP 1253485 A2 10/2002

(Continued)

OTHER PUBLICATIONS

International Search Report and Written Opinion mailed Aug. 31, 2012, in International Application No. PCT/JP2012/056050.

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes a developing unit for accommodating a developer, a rotatable member, rotatable in the developing unit, for stirring the developer, and a pressure-detecting portion for detecting a pressure applied by the rotatable member and for outputting a voltage signal corresponding to the pressure. The pressure-detecting portion is provided on the wall surface perpendicular to the rotational axis direction of the rotatable member in the developing unit. In addition, a discriminating portion discriminates an amount of the developer in the developing unit on the basis of a change in the voltage signal outputted from the pressure-detecting portion.

14 Claims, 21 Drawing Sheets

(56) References Cited

U.S. PATENT DOCUMENTS

| | | | | |
|---|---|---|---|---|
| 6,934,485 | B2 | 8/2005 | Miyabe et al. | |
| 2002/0191981 | A1 | 12/2002 | Miyabe et al. | |
| 2007/0258733 | A1 | 11/2007 | Yoshida et al. | |
| 2013/0156448 | A1* | 6/2013 | Ishii | 399/34 |
| 2013/0223857 | A1 | 8/2013 | Tsuchiya et al. | |

FOREIGN PATENT DOCUMENTS

| | | | |
|---|---|---|---|
| JP | 64-6986 | A | 1/1989 |
| JP | 2002-132036 | A | 5/2002 |

* cited by examiner

TABLE T

| SENSOR-ON TIME(msec) | RMNG TNR AMNT(%) |
|---|---|
| 8 | 100 |
| 35 | 90 |
| 62 | 80 |
| 89 | 70 |
| 114 | 60 |
| 139 | 50 |
| 162 | 40 |
| 184 | 30 |
| 204 | 20 |
| 221 | 10 |
| 236 | 0 |

(c) TABLE N

| A/D PORT INPT VLTG (V) | RMNG TNR AMNT(%) |
|---|---|
| 2.498 | 100 |
| 2.379 | 90 |
| 2.080 | 80 |
| 1.751 | 70 |
| 1.495 | 60 |
| 1.317 | 50 |
| 1.151 | 40 |
| 0.944 | 30 |
| 0.776 | 20 |
| 0.702 | 10 |
| 0.637 | 0 |

TABLE Q

| A/D PORT INPT VLTG (V) | TEMP.(°C) |
|---|---|
| 2.983 | 0 |
| 2.967 | 1 |
| 2.951 | 2 |
| 2.934 | 3 |
| 2.916 | 4 |
| 2.898 | 5 |
| 2.879 | 6 |
| 2.860 | 7 |
| 2.840 | 8 |
| 2.820 | 9 |
| 2.799 | 10 |
| 2.778 | 11 |
| 2.755 | 12 |
| 2.733 | 13 |
| 2.709 | 14 |
| 2.686 | 15 |
| 2.661 | 16 |
| 2.637 | 17 |
| 2.611 | 18 |
| 2.585 | 19 |
| 2.559 | 20 |
| 2.532 | 21 |
| 2.505 | 22 |
| 2.477 | 23 |
| 2.449 | 24 |
| 2.420 | 25 |
| 2.391 | 26 |
| 2.362 | 27 |
| 2.332 | 28 |
| 2.302 | 29 |
| 2.271 | 30 |

TABLE Q

| A/D PORT INPT VLTG (V) | TEMP.(°C) |
|---|---|
| 2.240 | 31 |
| 2.209 | 32 |
| 2.177 | 33 |
| 2.146 | 34 |
| 2.114 | 35 |
| 2.082 | 36 |
| 2.049 | 37 |
| 2.017 | 38 |
| 1.985 | 39 |
| 1.953 | 40 |
| 1.919 | 41 |
| 1.887 | 42 |
| 1.854 | 43 |
| 1.821 | 44 |
| 1.789 | 45 |
| 1.756 | 46 |
| 1.724 | 47 |
| 1.692 | 48 |
| 1.660 | 49 |
| 1.628 | 50 |

FIG.9D (a)

TABLE T

| SENSOR-ON TIME DIFFNC (msec) | RMNG TNR AMNT(%) |
|---|---|
| 655 | 100 |
| 635 | 90 |
| 622 | 80 |
| 616 | 70 |
| 569 | 60 |
| 556 | 50 |
| 544 | 40 |
| 531 | 30 |
| 528 | 20 |
| 505 | 10 |
| 490 | 0 |

(a)

(b)

(c)

TABLE N

| A/D PORT INPT VLTG (V) | RMNG TNR AMNT(%) |
|---|---|
| 2.20 | 100 |
| 2.08 | 90 |
| 1.78 | 80 |
| 1.45 | 70 |
| 1.20 | 60 |
| 1.02 | 50 |
| 0.85 | 40 |
| 0.64 | 30 |
| 0.48 | 20 |
| 0.40 | 10 |
| 0.34 | 0 |

TABLE Q

| A/D PORT INPT VLTG (V) | TEMP.(°C) |
|---|---|
| 2.983 | 0 |
| 2.967 | 1 |
| 2.951 | 2 |
| 2.934 | 3 |
| 2.916 | 4 |
| 2.898 | 5 |
| 2.879 | 6 |
| 2.860 | 7 |
| 2.840 | 8 |
| 2.820 | 9 |
| 2.799 | 10 |
| 2.778 | 11 |
| 2.755 | 12 |
| 2.733 | 13 |
| 2.709 | 14 |
| 2.686 | 15 |
| 2.661 | 16 |
| 2.637 | 17 |
| 2.611 | 18 |
| 2.585 | 19 |
| 2.559 | 20 |
| 2.532 | 21 |
| 2.505 | 22 |
| 2.477 | 23 |
| 2.449 | 24 |
| 2.420 | 25 |
| 2.391 | 26 |
| 2.362 | 27 |
| 2.332 | 28 |
| 2.302 | 29 |
| 2.271 | 30 |

TABLE Q

| A/D PORT INPT VLTG (V) | TEMP.(°C) |
|---|---|
| 2.240 | 31 |
| 2.209 | 32 |
| 2.177 | 33 |
| 2.146 | 34 |
| 2.114 | 35 |
| 2.082 | 36 |
| 2.049 | 37 |
| 2.017 | 38 |
| 1.985 | 39 |
| 1.953 | 40 |
| 1.919 | 41 |
| 1.887 | 42 |
| 1.854 | 43 |
| 1.821 | 44 |
| 1.789 | 45 |
| 1.756 | 46 |
| 1.724 | 47 |
| 1.692 | 48 |
| 1.660 | 49 |
| 1.628 | 50 |

FIG.19C

IMAGE FORMING APPARATUS

TECHNICAL FIELD

The present invention relates to a remaining amount detection of a toner which is a developer in an electrophotographic image forming apparatus such as a laser printer, a copying machine or a facsimile machine.

BACKGROUND ART

In a conventional image forming apparatus, there is an example in which the remaining amount of the toner in a toner container is detected by using a piezoelectric sensor or an ultrasonic sensor. For example, in a remaining toner amount detecting device described in Japanese Laid-Open Patent Application (JP-A) Hei 1-6986, during rotation of an agitator, the piezoelectric sensor having a detecting portion directed upward is provided on a bottom of a hopper at a position where a thin plate-like member provided at an end portion of the agitator passes in proximity to the sensor. Further, the remaining toner amount is detected from a time ratio between a time required for one rotation the agitator and a time for which the piezoelectric sensor detects pressure by the thin photo-like member. In this remaining toner amount detecting device, in the case where the remaining toner amount is not less than a certain amount, an output of the piezoelectric sensor is fixed to logic of the presence of the toner, and when the remaining toner amount is not more than the certain amount, the output of the piezoelectric sensor is fixed to logic of the absence of the toner.

However, in JP-A Hei 1-6986, there was the following problem. That is, when the remaining toner amount is large, a time for which the weight of the toner is not detected is not generated and therefore the remaining toner amount cannot be detected until the toner amount is decreased to the certain amount. Further, with speed-up of the image forming apparatus in recent years, when a stirring member is operated at high speed, the toner in a toner container is stirred up to result in a state in which the toner is present at a detection position of the piezoelectric sensor and therefore it is difficult to ensure the time for which the weight of the toner is not detected.

Further, in another conventional image forming apparatus, a permeability sensor is used in a device for detecting the amount of the toner (developer) in a developing unit. As an example of the device for detecting the amount of the developer by using the permeability sensor, e.g., there is the detecting device as disclosed in JP-A 2002-132036. JP-A 2002-132036 discloses the toner amount detecting device which uses a flexible first stirring blade deformed toward a rear side with respect to a rotational direction by stirring the toner, a rigid second stirring blade provided at the rear side of the first stirring blade with respect to the rotational direction, and the permeability sensor provided outside the bottom of the developing unit. This device detects a state of a rotating operation of a metal material provided on each of the stirring blades by the permeability sensor provided outside the bottom of the developing unit. Further, this device is constituted so that in the case where the toner amount in the developing unit is large, the first stirring blade and the second stirring blade integrally perform the rotating operation and so that in the case where the toner amount in the developing unit is small, the first stirring blade and the second stirring blade separately perform the rotating operation without being deformed. In this case, when the toner amount is detected by using the permeability sensor, a change in permeability per rotation of a rotation shaft is detected once in the case where the toner amount in the developing unit is large and is detected twice in the case where the toner amount in the developing unit is small. The toner amount detecting device detects the toner amount in the developing unit on the basis of the change in number of this detection.

However, the detecting device of JP-A 2002-132036 involves the following problem. In the case where the first and second stirring blades integrally perform the rotating operation and therefore a signal detected by the permeability sensor indicates one change of the permeability per rotation of the rotation shaft. On the other hand, in the case where the toner amount is small, the first stirring blade is little deformed and thus the first and second stirring blade do not integrally perform the rotating operation. At this time, the signal detected by the permeability sensor indicates two changes of the permeability per rotation of the rotation shaft. In this case, selective detection of the amount of the toner or the presence/absence of the toner is made depending on the number (once or twice) of the change in magnetic field detected by the permeability sensor. For this reason, it is difficult to detect the change in toner amount in real time.

DISCLOSURE OF THE INVENTION

The present invention has been accomplished in these circumstances. A principal object of the present invention is to provide an image forming apparatus capable of detecting a remaining toner amount in real time by a simple constitution and capable of detecting the remaining toner amount even when the stirring member is operated at high speed.

According to an aspect of the present invention, there is provided an image forming apparatus comprising: a developing unit for accommodating a developer; a rotatable member rotatable in the developing unit, wherein the rotatable member includes a pressure-applying portion for applying pressure to a wall surface perpendicular to a rotational axis direction; a pressure-detecting portion for detecting the pressure applied by the pressure-applying portion of the rotatable member, wherein the pressure-detecting portion is provided on the wall surface perpendicular to the rotational axis direction of the rotatable member in the developing unit; and a discriminating portion for discriminating an amount of the developer in the developing unit on the basis of a detection result of the pressure-detecting portion.

According to another aspect of the present invention, there is provided an image forming apparatus comprising: a first rotatable member, having flexiblity, for being rotated about a rotation shaft in a developing unit for accommodating a developer; a second rotatable member, having flexibility different from the flexiblity of the first rotatable member, for being rotated about a rotation shaft in a developing unit for accommodating a developer; a pressure-detecting portion for detecting pressure applied by each of the first rotatable member and the second rotatable member, wherein the pressure-detecting portion is provided on a wall surface perpendicular to a developer of the rotation shaft; and a detecting portion for detecting an amount of the developer in the developing unit on the basis of a detection result of the pressure-detecting portion.

These and other objects, features and advantages of the present invention will become more apparent upon a consideration of the following description of the preferred embodiments of the present invention taken in conjunction with the accompanying drawings.

Figure 2:
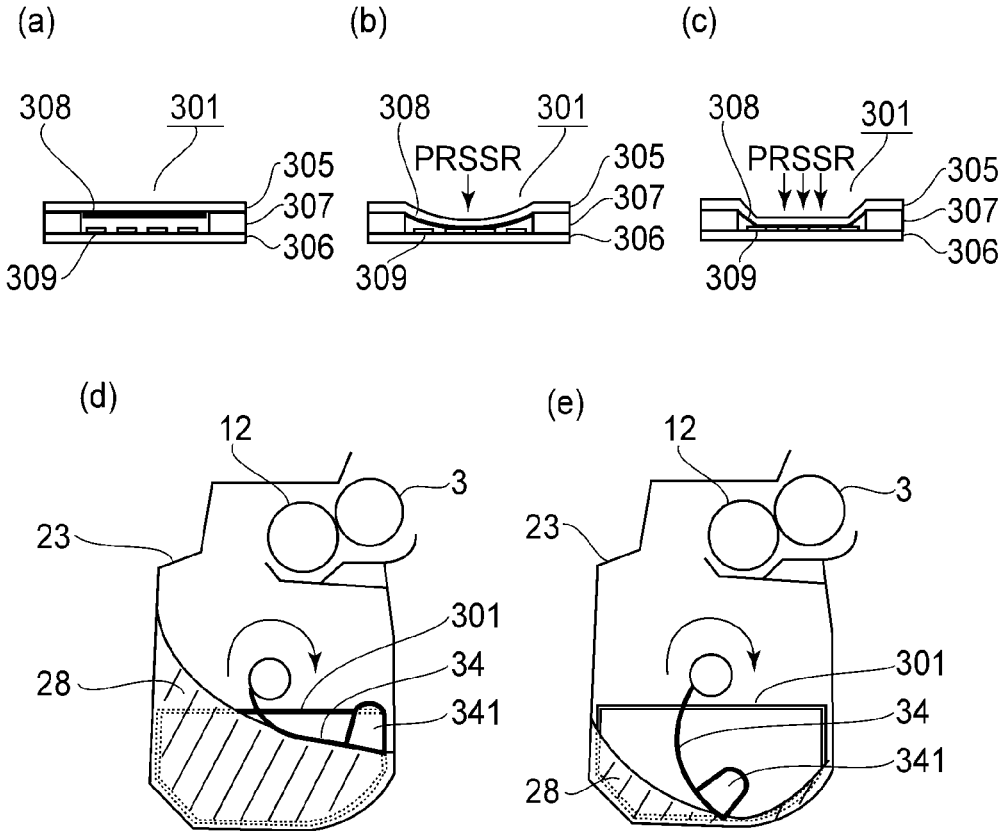

Parts (a) to (e) of FIG. 2 are sectional views of a pressure-sensitive resistance sensor and a developing unit in Embodiments 1 to 3.

Figure 3:
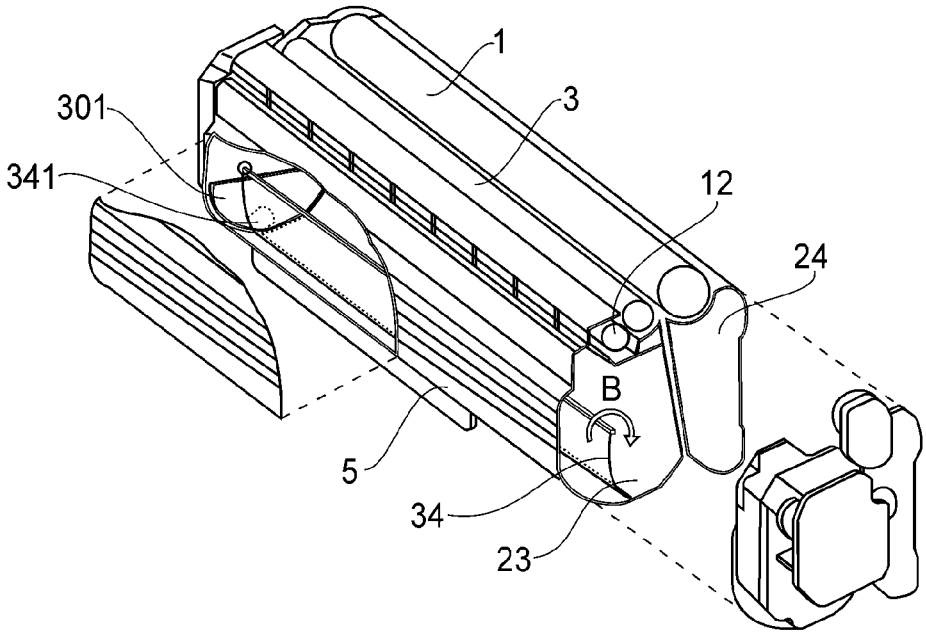

FIG. 3 is a perspective view of a process cartridge in Embodiments 1 to 3.

Figure 4:
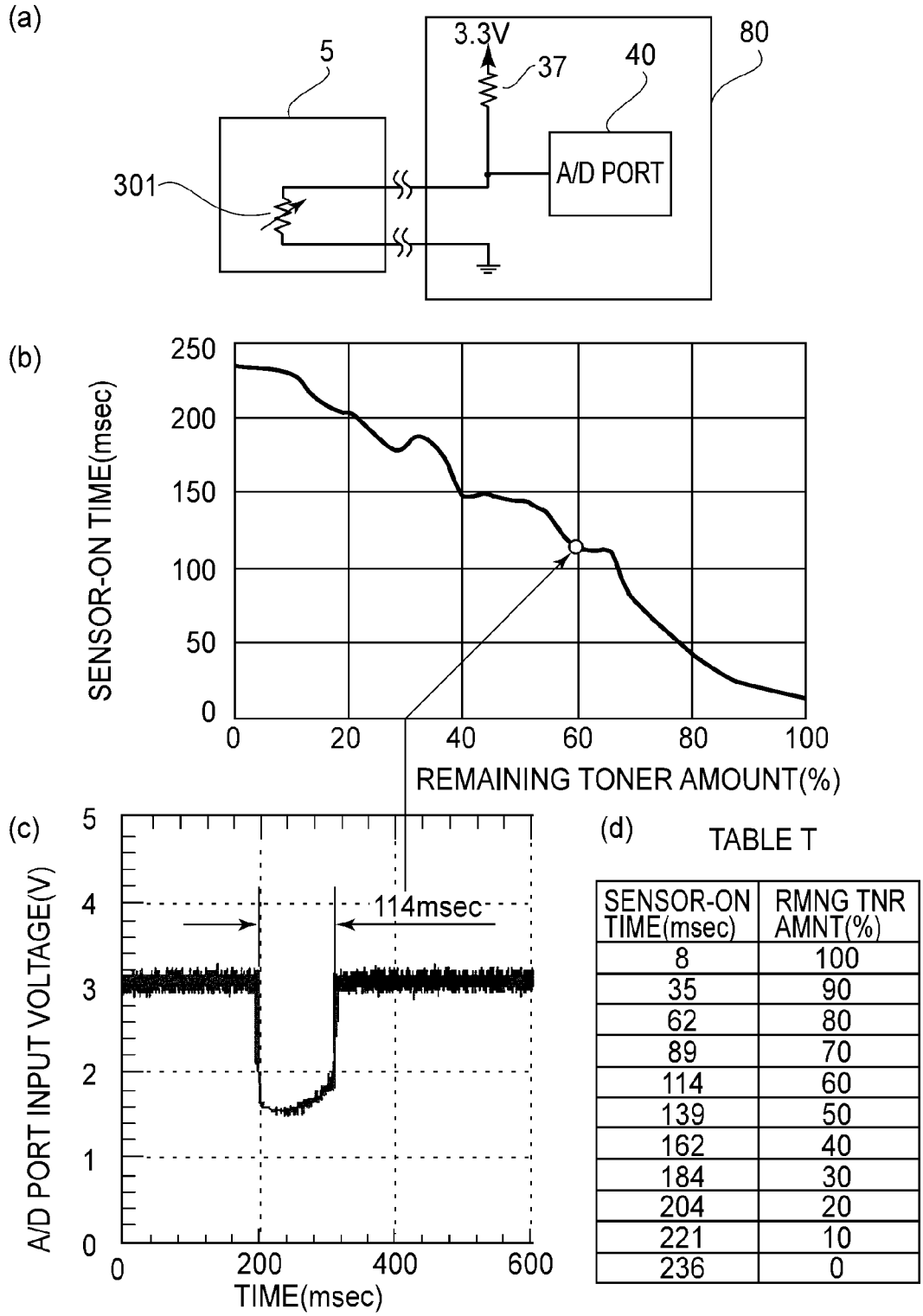

Parts (a) to (d) of FIG. 4 are a circuit diagram, a characteristic graph, a voltage waveform and a table T, respectively, in Embodiment 1.

Figure 5:
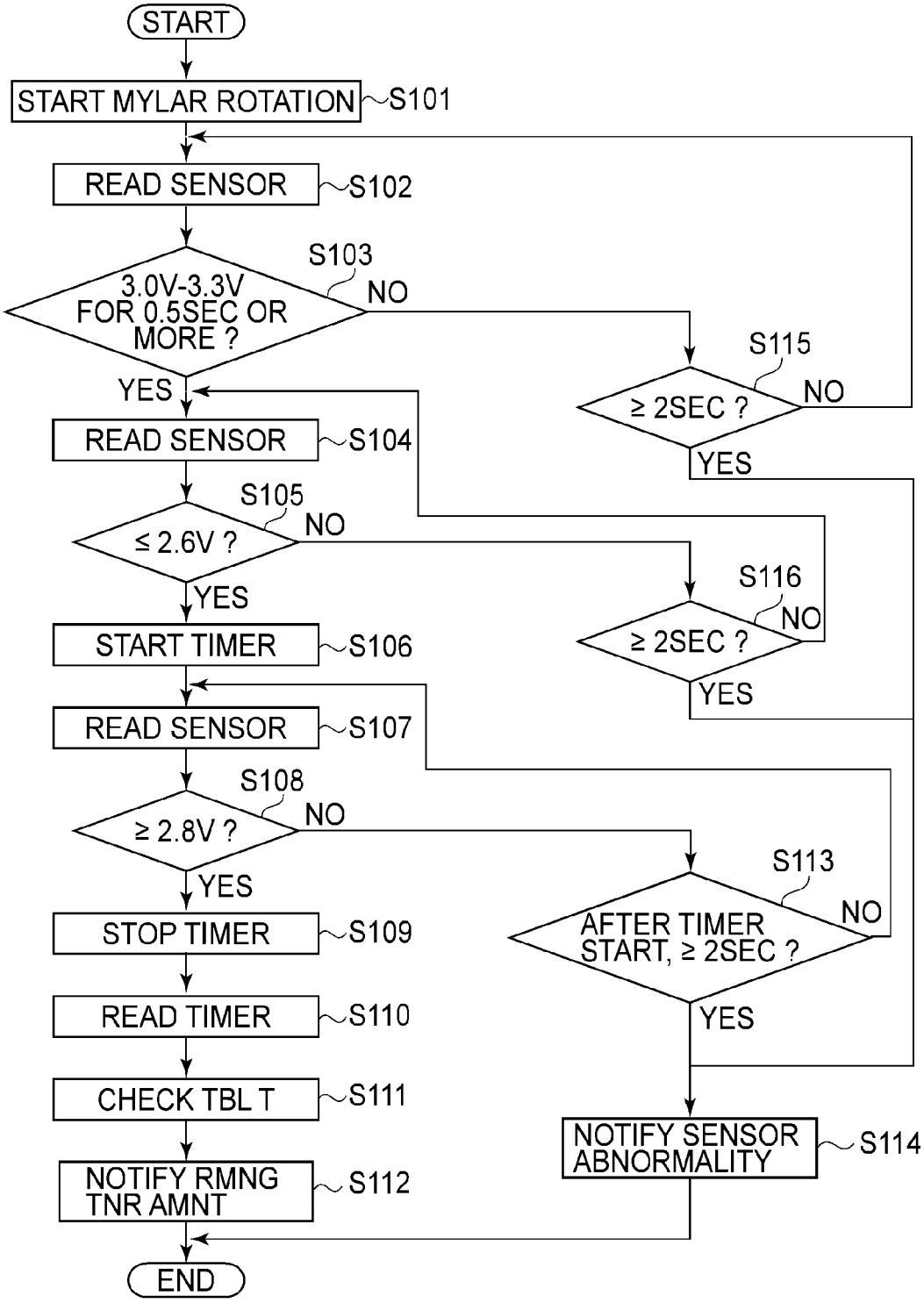

FIG. 5 is a flow chart showing a processing sequence of remaining toner amount detection in Embodiment 1.

Figure 6:
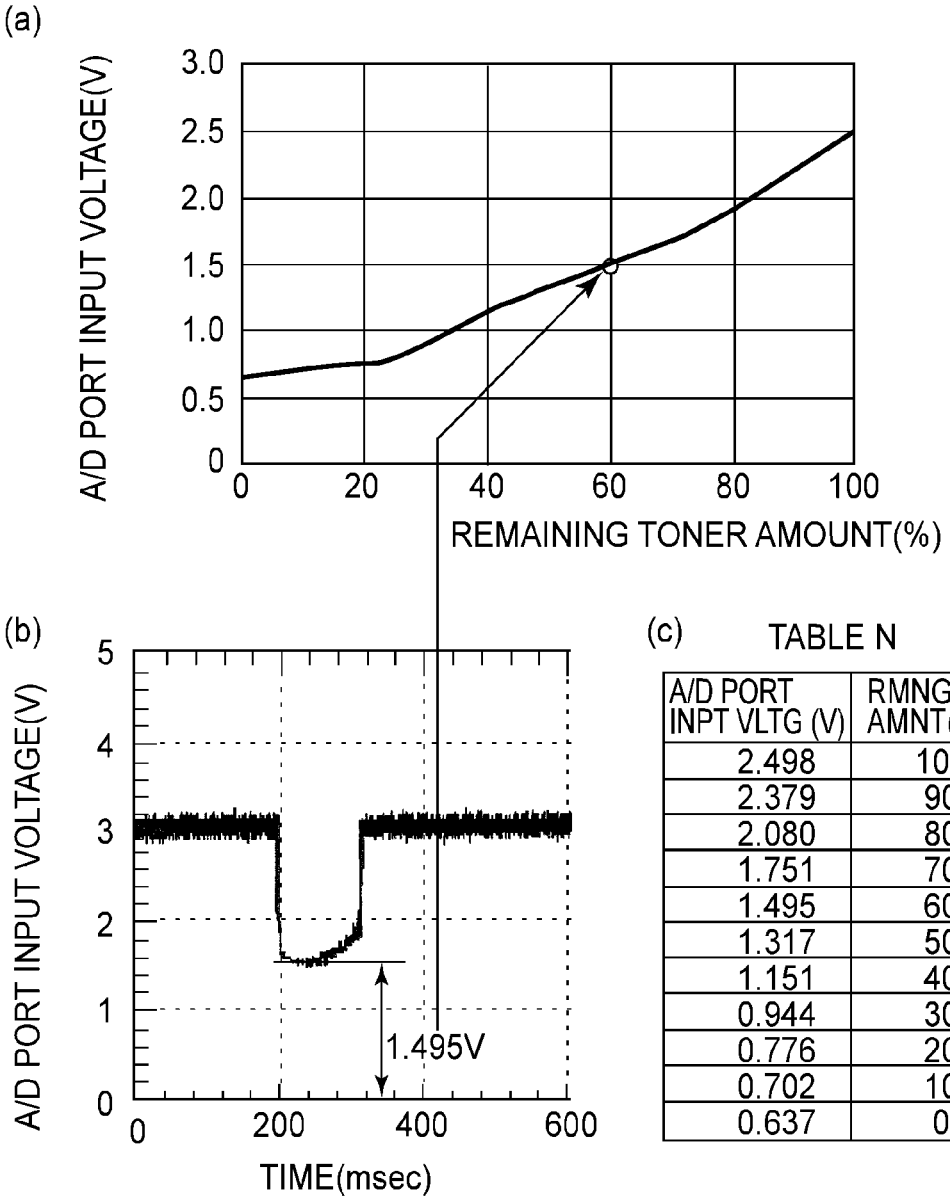

Parts (a) to (c) of FIG. 6 are a characteristic graph, a voltage waveform and a table N, respectively, in Embodiment 2.

Figure 7:
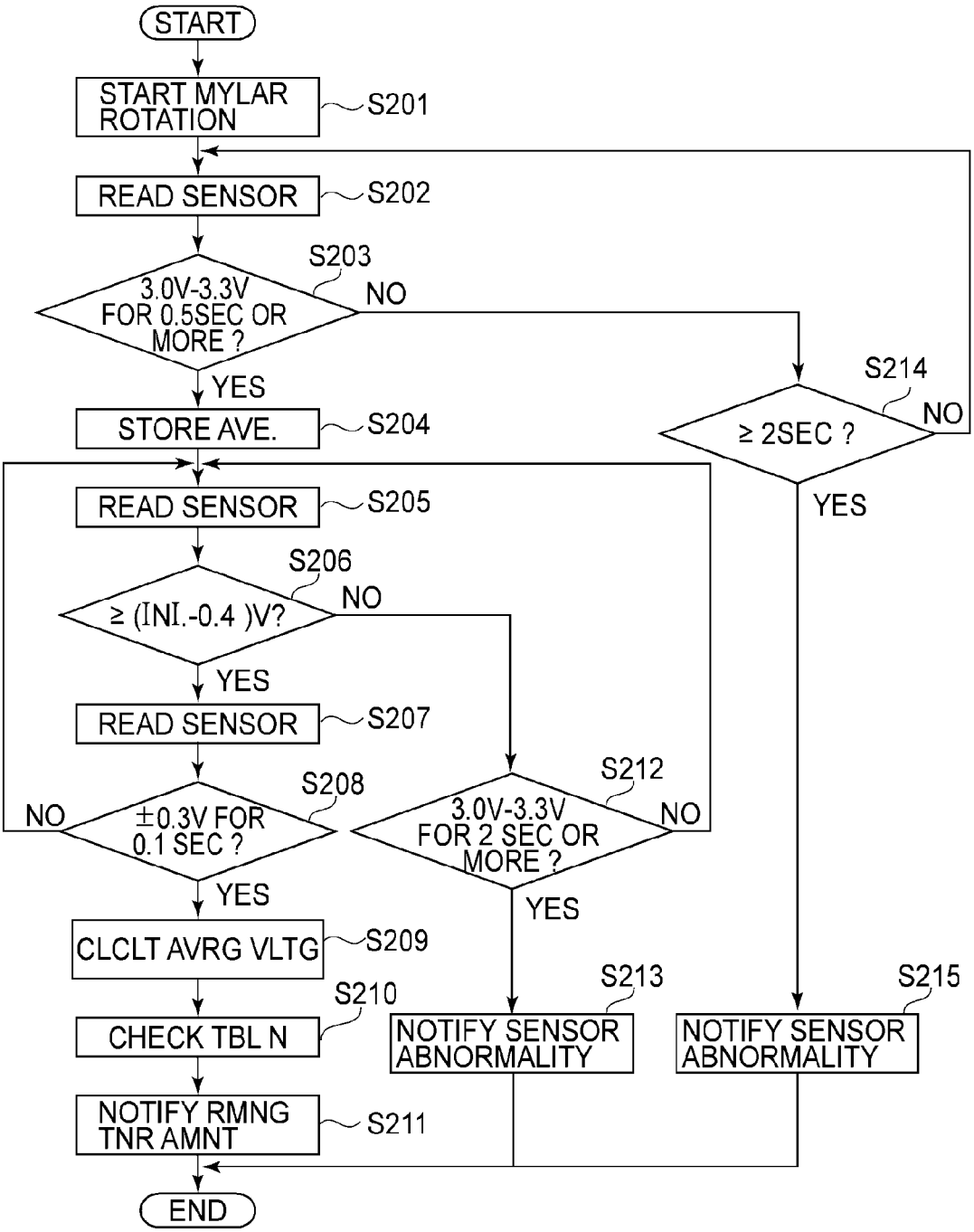

FIG. 7 is a flow chart showing a processing sequence of remaining toner amount detection in Embodiment 2.

Figure 8:
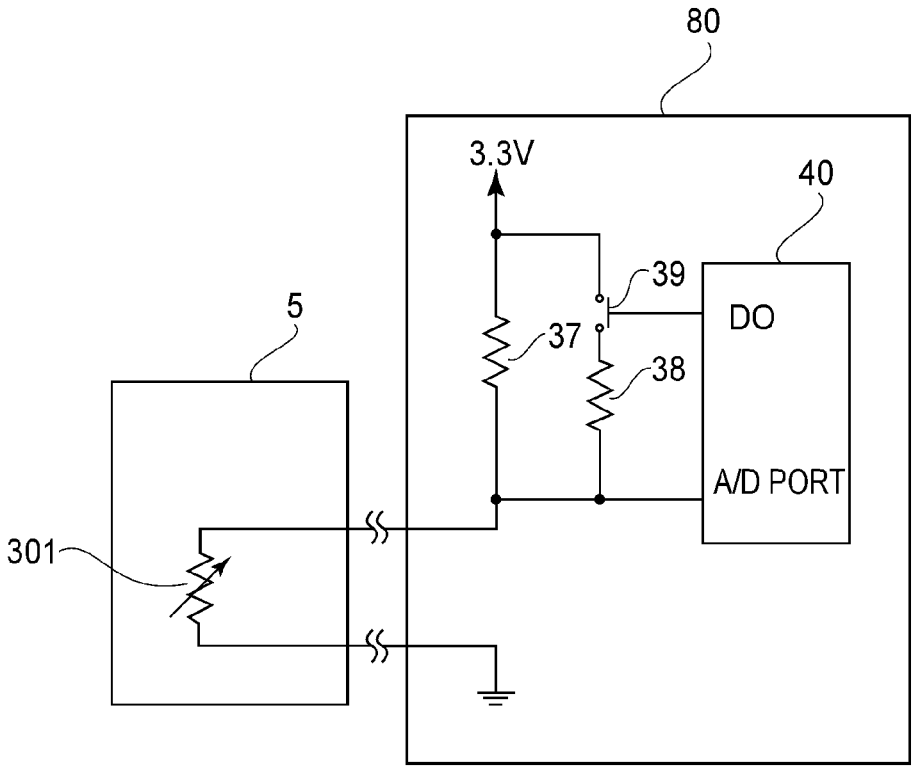

FIG. 8 is a diagram showing a circuit structure for switching a voltage division resistance value in Embodiment 2.

FIG. 9A to FIG. 9D are a circuit diagram, a characteristic graph, a voltage waveform and a table Q, respectively, in Embodiment 3.

Figure 10:
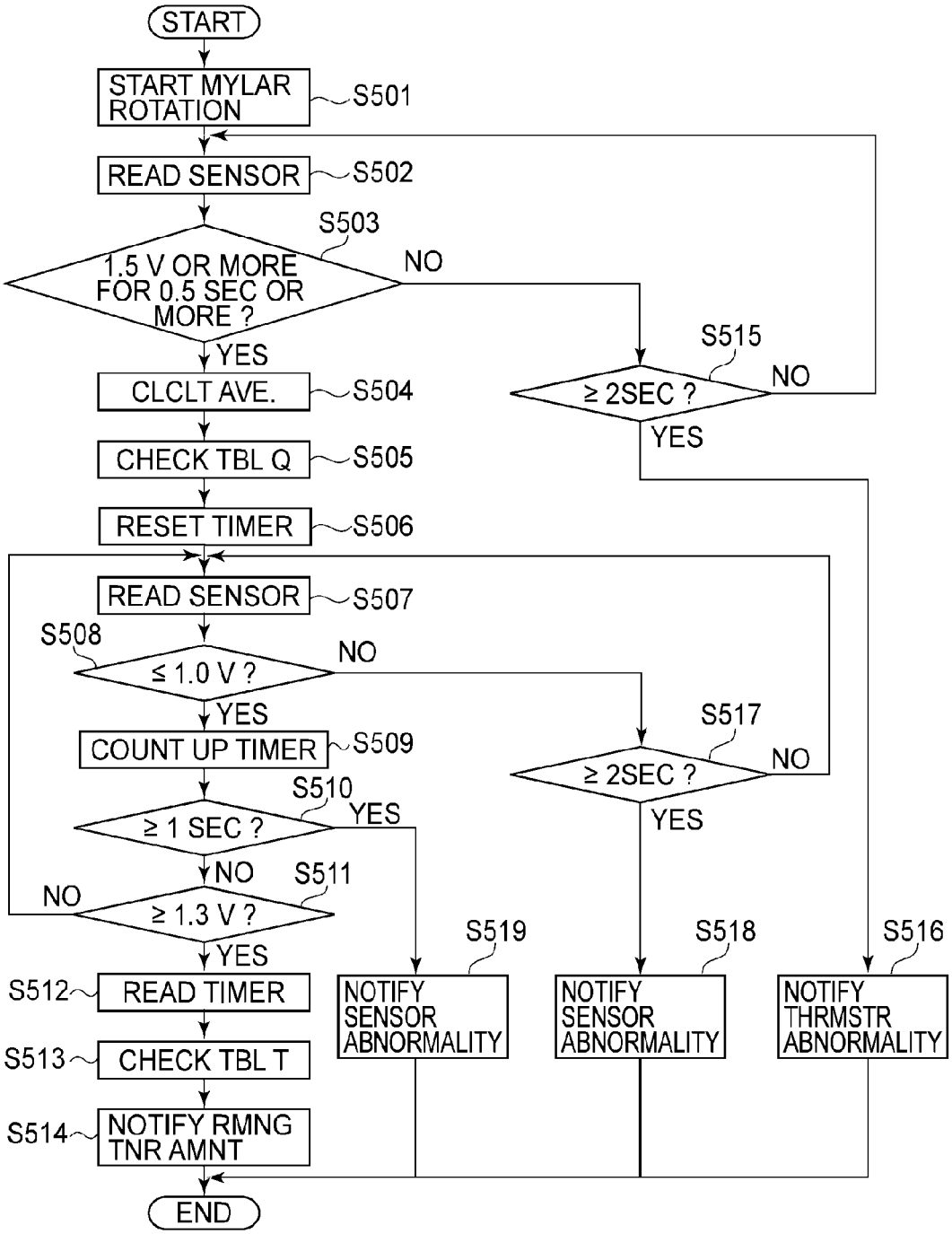

FIG. 10 is a flow chart showing a processing sequence of remaining toner amount detection in Embodiment 3.

Figure 11:
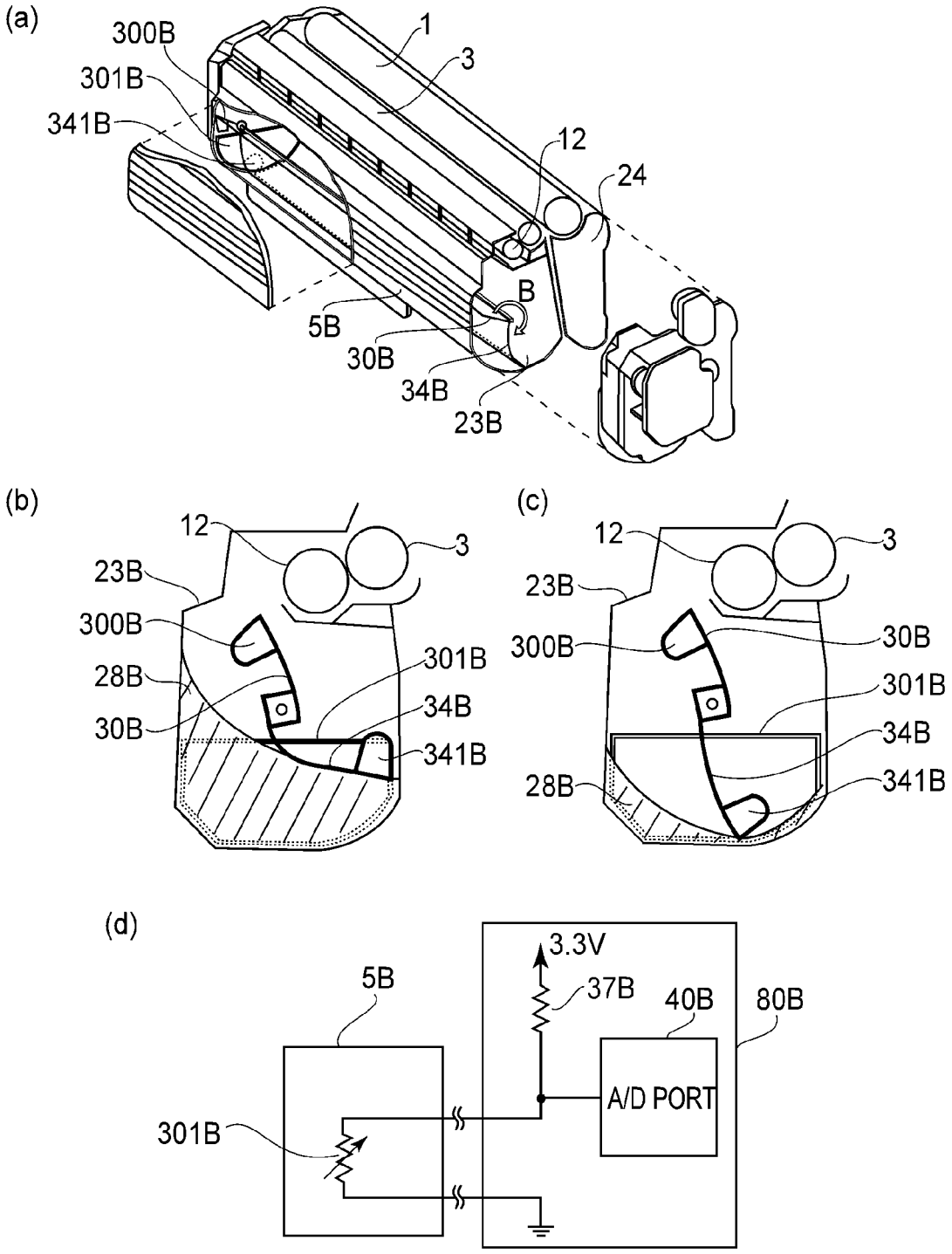

Parts (a) to (d) of FIG. 11 are a perspective view of a process cartridge, a sectional view of the process cartridge, a sectional view of the process cartridge and a circuit diagram of remaining toner amount detection, respectively, in Embodiment 4.

Figure 12:
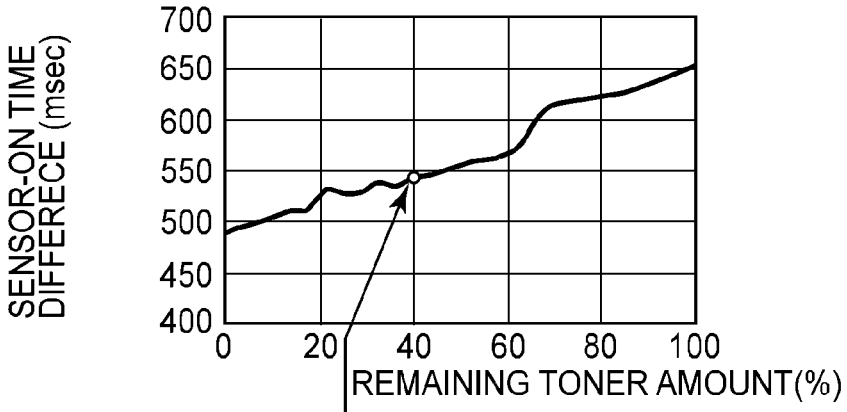
Figure 12:
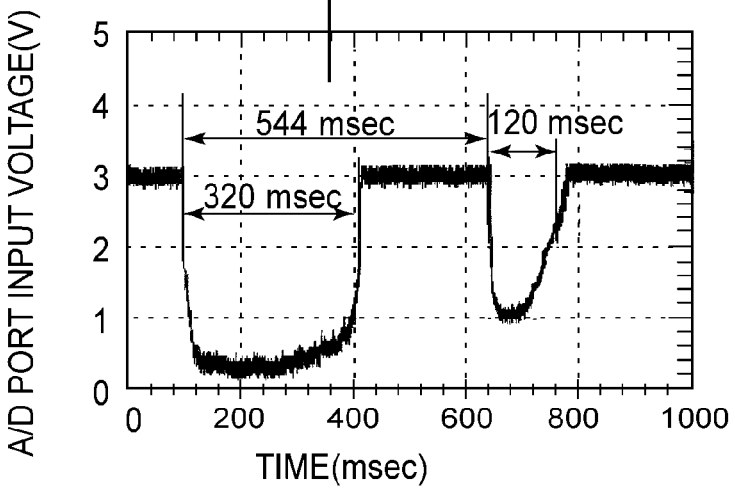

Parts (a) to (c) of FIG. 12 are a remaining toner amount characteristic, a voltage waveform and a table T, respectively, in Embodiment 4.

Figure 13:
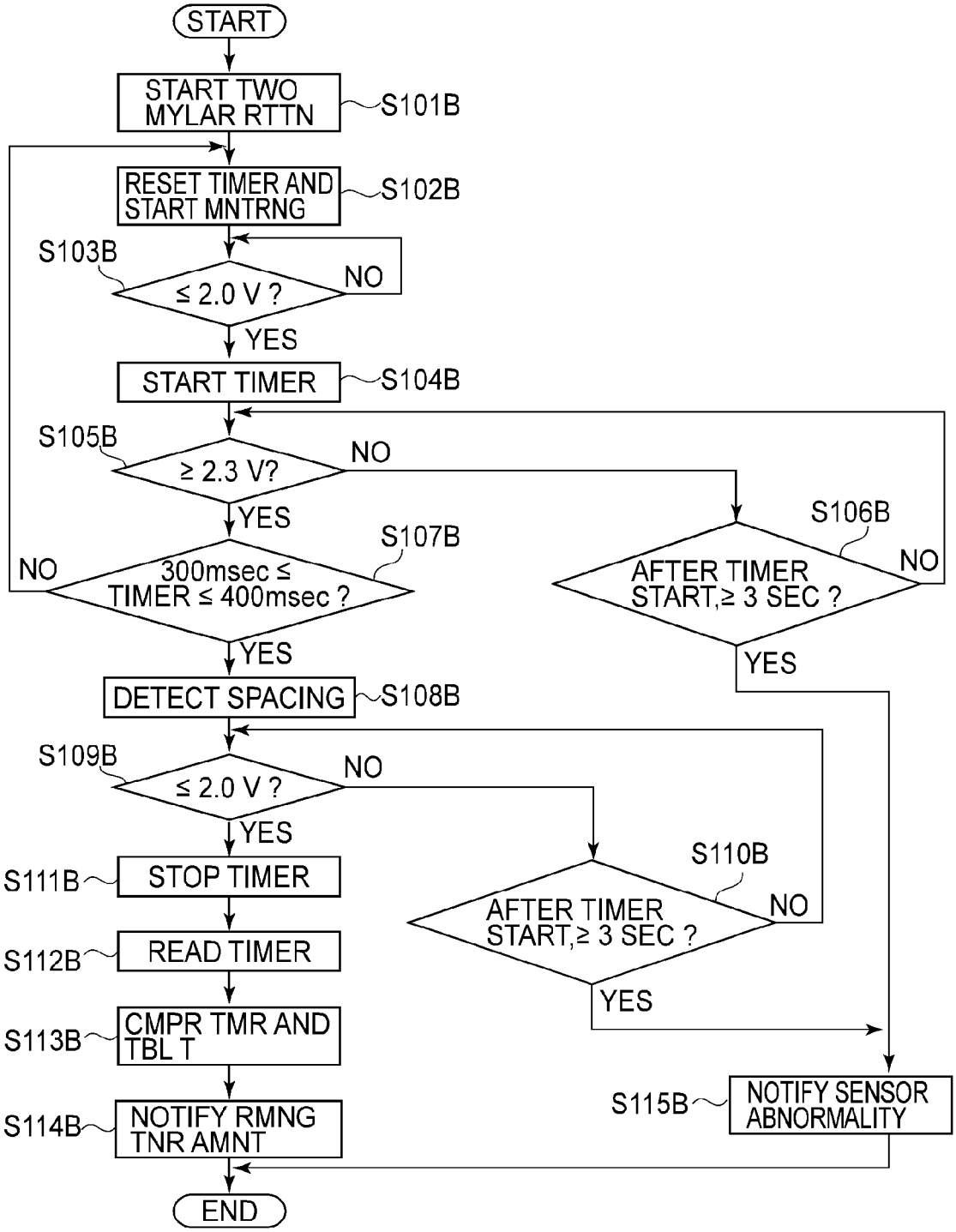

FIG. 13 is a flow chart showing a processing sequence of remaining toner amount detection in Embodiment 4.

Figure 14:
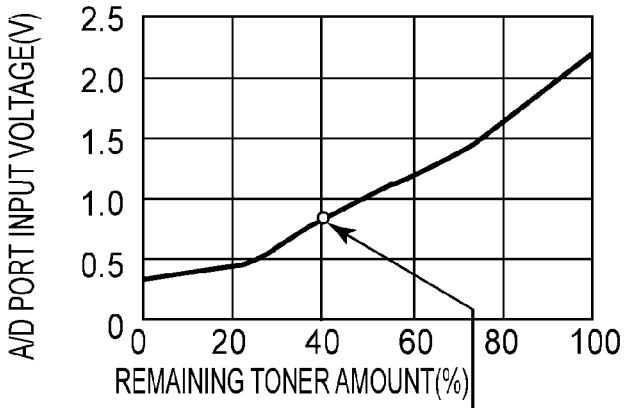
Figure 14:
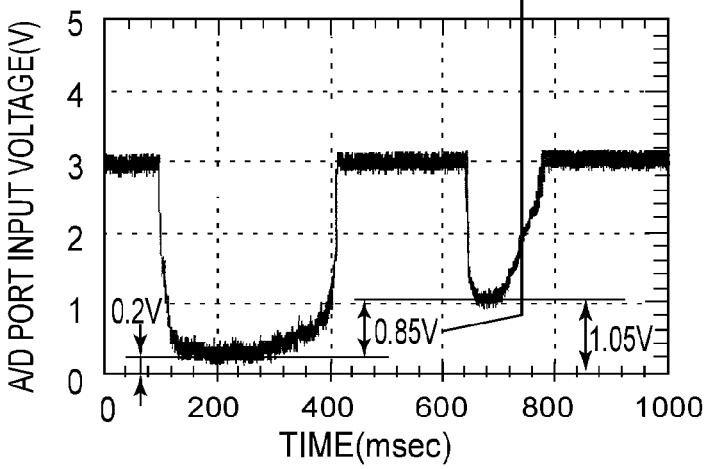

Parts (a) to (c) of FIG. 14 are a remaining toner amount characteristic graph, a voltage waveform and a table N, respectively, in Embodiment 5.

Figure 15:
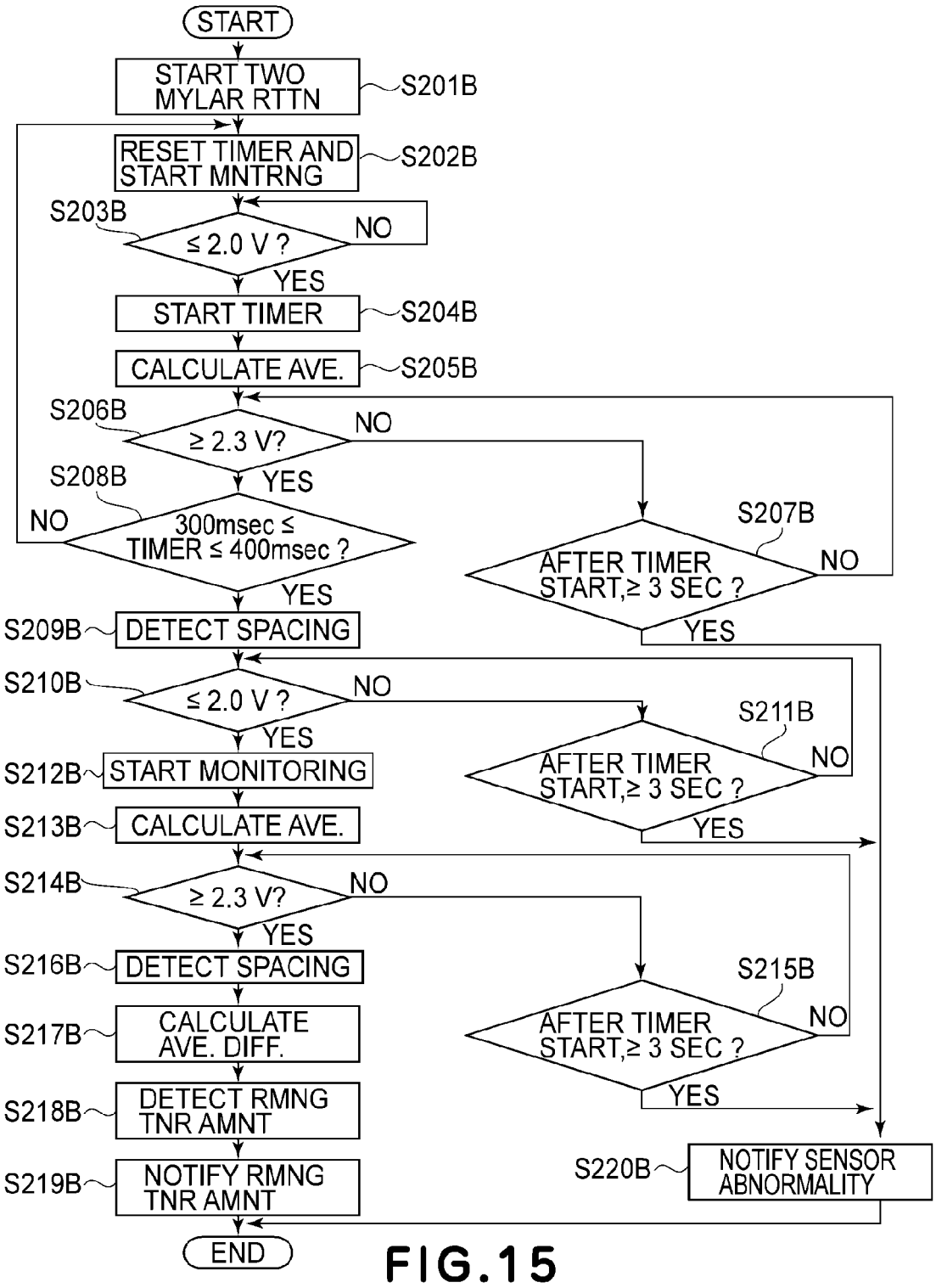

FIG. 15 is a flow chart of remaining toner amount detection in Embodiment 5.

Figure 16:
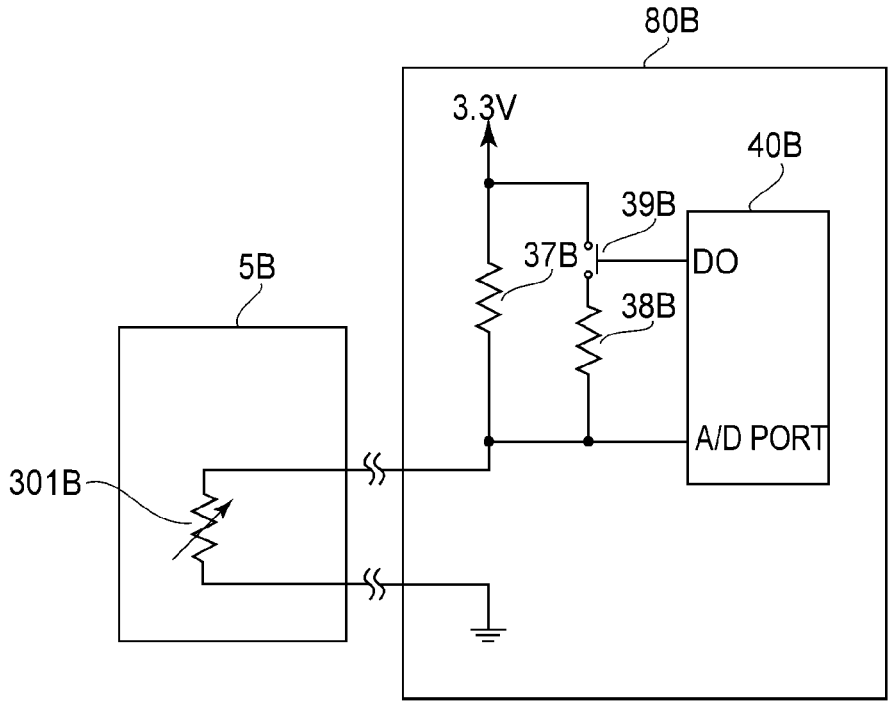

FIG. 16 is a remaining toner amount detection circuit diagram in which a voltage division resistance value is switched in Embodiment 5.

Figure 17:
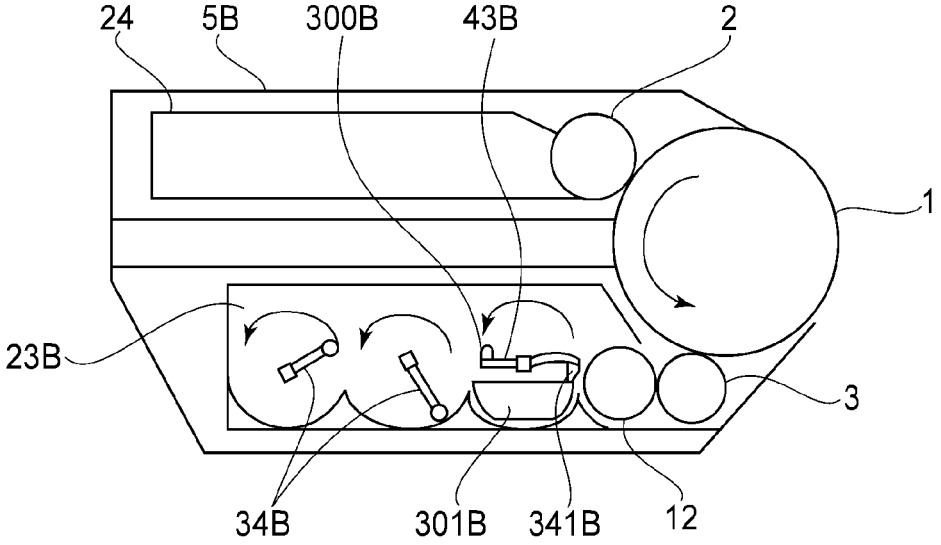

FIG. 17 is a sectional view of a developing unit in Embodiments 6 and 7.

Figure 18:
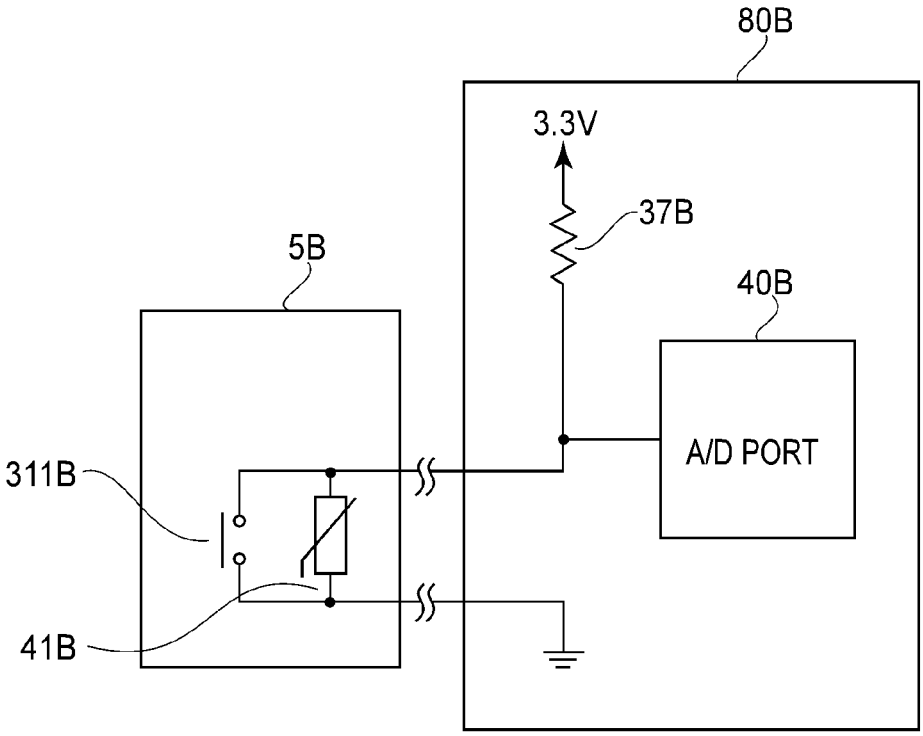

FIG. 18 is a circuit diagram of remaining toner amount detection in Embodiment 8.

Figure 19A:
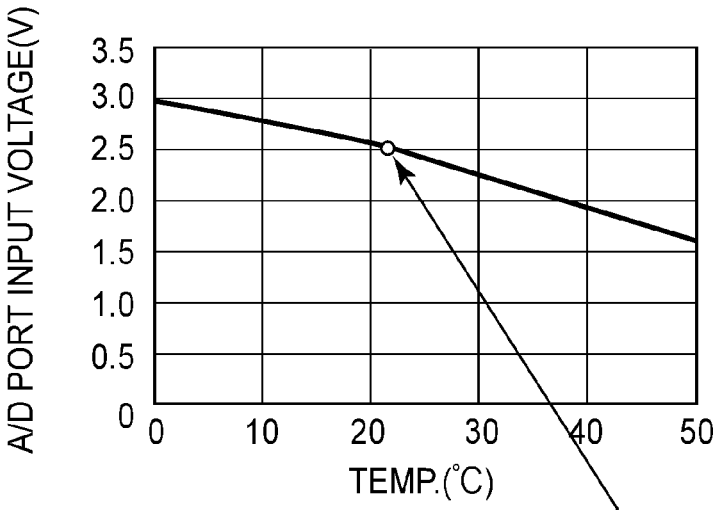
Figure 19B:
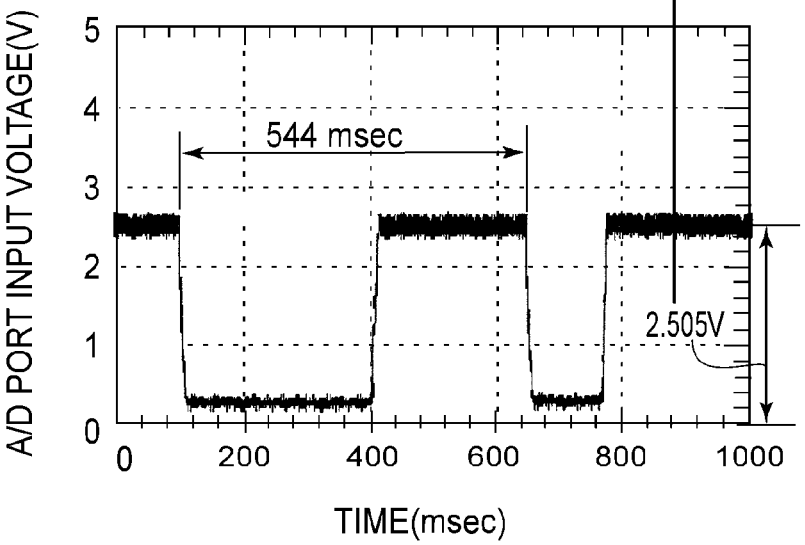

FIG. 19A to FIG. 19C are a remaining toner amount characteristic graph, a voltage waveform and a table Q, respectively, in Embodiment 8.

Figure 20:
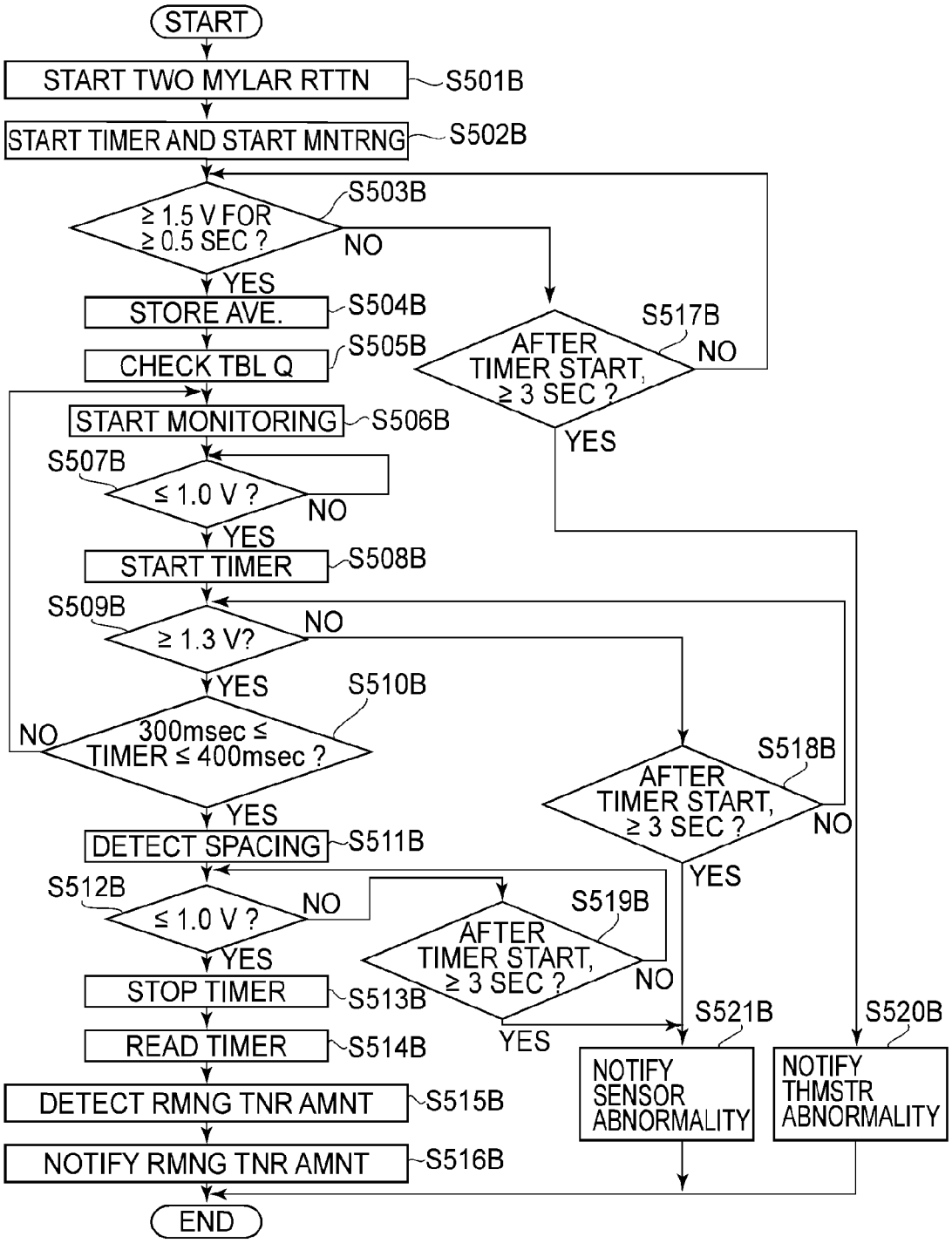

FIG. 20 is a flow chart showing a processing sequence of remaining toner amount detection in Embodiment 8.

BEST MODE FOR CARRYING OUT THE INVENTION

Hereinbelow, a constitution and operation of the present invention will be described. Incidentally, the following embodiments are an example of the present invention and a technical scope of the present invention is not limited to only these embodiments. With reference to the drawings, modes for carrying out the present invention will be specifically described below based on the following embodiments.

Embodiment 1

Image Forming Apparatus

Figure 1:
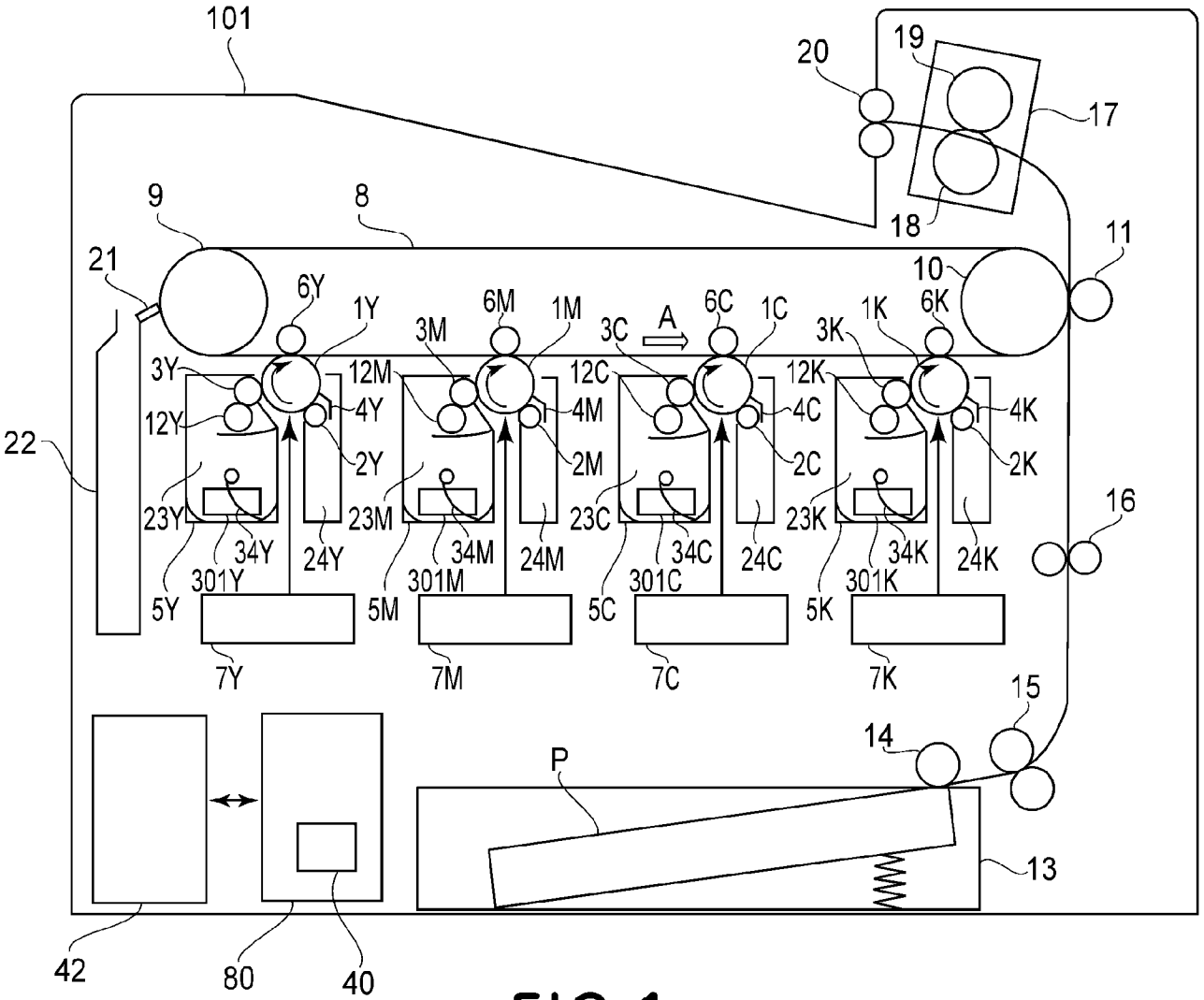
FIG. 1 is a sectional view showing a schematic structure of a color laser printer in Embodiments 1 to 3.

FIG. 1 is a sectional view showing a general structure of a color laser printer which is an example of an image forming apparatus in this embodiment, and a constitution and basic operation of the color laser printer will be described with reference to FIG. 1. The color laser printer (hereinafter referred to as a main assembly 101) includes process cartridges 5Y, 5M, 5C and 5K which are detachably mountable to the main assembly 101. These four process cartridges 5Y, 5M, 5C and 5K have the same structure but are different in that they form images with toners (developers) of yellow (Y), magenta (M), cyan (C) and black (K), respectively. Hereinafter, the suffixes Y, M, C and K will be omitted in some cases. The process cartridge 5 is constituted by 3 units consisting of a developing unit, an image forming unit and a residual toner unit. The developing unit includes a developing roller 3, a toner supplying roller 12, a toner container 23 and a polyester (terephthalate) stirring film (Mylar) 34. Further, the image forming unit includes a photosensitive drum 1 which is an image bearing member, and a charging roller 2. The residual toner unit includes a cleaning blade 4 and a residual toner container 24. Incidentally, a pressure-sensitive resistance sensor 301 provided in the developing unit will be described later.

Below the process cartridge 5, a laser unit 7 is provided and exposes the photosensitive drum 1 to light on the basis of an image signal. The photosensitive drum 1 is charged to a predetermined negative potential by the charging roller 2 and then an electrostatic latent image is formed thereon by the laser unit 7. The electrostatic latent image is reversely developed by the developing roller 3, so that the negative toner is deposited on the electrostatic latent image and thus toner images of Y, M, C and K are formed on the respective photosensitive drums 1. An intermediary transfer belt unit is constituted by an intermediary transfer belt 8, a driving roller 9 and a secondary transfer opposite roller 10. Inside the intermediary transfer belt 8, a primary transfer roller 6 is provided opposed to an associated photosensitive drum 1, and a transfer bias is applied to the primary transfer roller 6 by a bias applying means (not shown).

The toner images formed on the photosensitive drums 1 are rotated in arrow directions indicated in the photosensitive drums 1, and the intermediary transfer belt 8 is rotated in an arrow A direction. Further, by a bias applying means (not shown), a positive bias is applied to the primary rollers 6, so that the toner images on the photosensitive drums 1 are primary-transferred onto the intermediary transfer belt 8 in the order of those of Y, M, C and K and then are conveyed to a secondary transfer roller 11 in a superposition state of the four color toner images. A sheet feeding device is constituted by a sheet (paper) feeding roller 14 for feeding a transfer(-receiving) material P from a sheet feeding cassette 13 which accommodates sheets of the transfer material P and a conveying roller pair 15 for conveying the fed transfer material P. The transfer material P fed by the sheet feeding device is conveyed to the secondary transfer roller 11 by a registration roller pair 16.

The transfer of the toner images from the intermediary transfer belt 8 onto the transfer material P is effected by applying a positive bias to the primary transfer roller 11, so that the toner images on the intermediary transfer belt 8 are secondary-transferred onto the conveyed transfer material P. The transfer material P on which the toner images are transferred is conveyed into a fixing device 17 and is heated and pressed by a fixing film 18 and a pressing roller 19, so that the toner images are fixed on the surface of the transfer material P and then the transfer material P is discharged by a discharging roller pair 20. Then, the toner remaining on the surface of the photosensitive drum 1 after the transfer onto the intermediary transfer belt 8 is removed by the cleaning blade, so that the removed toner is collected in the residual toner container 24. Further, the toner remaining on the intermediary transfer belt 8 after the secondary transfer onto the transfer material P is removed by a transfer belt cleaning blade 21, so that the removed toner is collected in a residual toner container 22.

Further, on a control board (substrate) 80, a one-chip microcomputer 40 for effecting control of the main assembly (hereinafter referred to as CPU) and a storing portion including RAM, ROM and the like for storing data or the like for tables are mounted. The CPU 40 effects integrated control of the operation of the main assembly, such as control of driving sources (not shown) relating to the conveyance of the transfer material P and driving sources (not shown) for the process cartridges, control relating to image formation, and control relating to failure detection. Further, the CPU 40 is provided with a timer therein. In ROM of the storing portion, programs and various data for controlling the image forming operation of the image forming apparatus are stored. RAM of the storing portion is used for computation, temporary storing and the like of data necessary to control the image forming operation of the image forming apparatus. Further, the toner image is used for measurement of time or the like. A video controller 42 controls light emission of a laser in the laser unit on the basis of image data. Further, the video controller 42 also interfaces with a user via a control panel (not shown), and on the control panel, a remaining amount of the toner of each color is displayed in the form of a bar chart (graph).

[Constitution of Pressure-Sensitive Resistance Sensor]

Next, the pressure-sensitive resistance sensor 301 functioning as a remaining toner amount sensor will be described. The pressure-sensitive resistance sensor 301 which is a pressure-sensitive element in this embodiment includes a one-layer wiring pattern and an electroconductive ink layer, and a spacer is provided at a periphery between respective layers to form a space (gap). The pressure-sensitive resistance sensor 301 has a constitution in which when an upper surface of a detection surface is pressed, an electroconductive ink surface at the upper surface is deformed and is contacted to the wiring pattern at a lower surface. By such a constitution, a resistance value is fluctuated depending on a contact area corresponding to the applied pressure. In this embodiment, as the pressure-sensitive resistance sensor 301, a pressure-sensitive resistance sensor ("CP 1642", mfd. by IEE (International Electronics & Engineering S.A.) is used.

Parts (a) to (c) of FIG. 2 are sectional views of the pressure-sensitive resistance sensor 301 for performing pressure detection in this embodiment. A sheet 305 and a sheet 306 are a sheet-like member and a spacer 307 forms a space (gap) at a periphery between the sheets 305 and 306. An electroconductive ink 308 is located at the lower surface of the sheet 305, and an electrode pattern 309 is formed on the sheet 306. Further, the upper surface of the sheet 305 is the detection surface, and when the pressure is applied to the detection surface, the upper surface of the sheet 305 is deformed, so that the electroconductive ink 308 is contacted to the electroconductive pattern 309 below the electroconductive ink 309.

Part (a) of FIG. 2 shows a state in which the pressure is not applied to the detection surface of the pressure-sensitive resistance sensor 301, and the electrode pattern 309 is not contacted to the electroconductive ink 308 at four portions including central two portions. Part (b) of FIG. 2 shows a state in which small pressure is applied to the detection surface of the pressure-sensitive resistance sensor 301, and the electrode pattern 309 is contacted to the electroconductive ink 308 at the central two portions. Part (c) of FIG. 2 shows a state in which large pressure is applied to the detection surface of the pressure-sensitive resistance sensor 301, and the electrode pattern 309 is contacted to the electroconductive ink 308 at the four portions to increase a contact area also with respect to a longitudinal direction of the electrode pattern 309 (i.e., a direction perpendicular to the drawing sheet surface). In such a constitution, the pressure-sensitive resistance sensor 301 shows a characteristic such that a magnitude of the pressure and a resistance value are in inverse proportion, i.e., such a characteristic that the resistance value becomes large when the pressure is small and becomes small when the pressure is large.

[Constitution of Developing Unit]

FIG. 3 is a perspective view of the contact 5. In FIG. 3, the photosensitive drum 1, the developing roller 3, the toner supplying roller 12, the toner container 23 and the residual toner container 24 have already been described with reference to FIG. 1 and thus will be omitted from description. In the toner container 23 of the contact 5, a polyester stirring film 34 which is a paddle (rotatable) member for stirring the toner (not shown) in the toner container 23 is provided. The polyester stirring film 34 having flexible is provided to a rotation shaft in the toner container 23 and performs paddling (circulating operation) in an arrow B direction at a speed of one full turn (circumference) per se. Further, the polyester stirring film 34 includes a pressure-applying portion 341, in the neighborhood of a circumferential end, for applying the pressure to a wall surface perpendicular to the direction of the rotation shaft (rotational axis direction) in the container. The pressure-applying portion 341 is constituted integrally with the polyester stirring film 34, and its member has the same flexibility as the polyester stirring film 34, but another member may also be attached to the polyester stirring film 34 as the member having the flexibility.

The pressure-sensitive resistance sensor 301 is provided at the toner container wall surface perpendicular to the axial direction of the polyester stirring film 34 and detects the pressure applied by the pressure-applying portion 341 of the polyester stirring film 34 at a lower side of the rotation shaft of the polyester stirring film 34 with respect to the gravitational direction. Further, with respect to the pressure-sensitive resistance sensor 301, the developing portion and the wiring portion are integrally constituted. The sheet 305 as the detection surface of the pressure is bonded and fixed so as to be located inside the toner container 23. The wiring portion is lead out to the outside of the developing unit and a lead-out port is hermetically sealed. Further, the pressure-sensitive resistance sensor 301 is connected with the main assembly 101 via two electrodes (not shown) contacted when the process cartridge 5 is mounted to the main assembly 101.

Parts (d) and (e) of FIG. 2 are sectional views of the developing unit shown in FIG. 3, wherein (d) shows the case where the remaining toner amount is large and (e) shows the case where the remaining toner amount is small. When the pressure-applying portion 341 which is paddled and rotated reaches the pressure-sensitive resistance sensor 301, the pressure-applying portion 341 applies the pressure to the pressure-sensitive resistance sensor 301. Further, when the pressure-applying portion 341 is paddled and rotated, the polyester stirring film 34 reaches the toner, so that the toner enters between the pressure-applying portion 341 and the pressure-sensitive resistance sensor 301. The toner which has entered functions as a buffering (cushioning) member and therefore the pressure applied from the pressure-applying portion 341 to the pressure-sensitive resistance sensor 301 is lowered. Then, when the pressure-applying portion 341 is paddled and rotated and thus the toner further enters between the pressure-applying portion 341 and the pressure-sensitive resistance sensor 301, the pressure applied to the pressure-sensitive resistance sensor 301 is eliminated. As a result, in a period from the time when the pressure-applying portion 341 passes through the pressure-sensitive resistance sensor 301 until the pressure-applying portion 341 reaches the pressure-sensitive resistance sensor 301 again, there is no pressure applied to the pressure-sensitive resistance sensor 301 by the pressure-applying portion 341.

In the case where the remaining toner amount is large, as shown in (d) of FIG. 2, the time when the toner 28 is interposed between the pressure-applying portion 341 and the pressure-sensitive resistance sensor 301 is long and therefore a time duration (time width) for which the pressure-applying portion 341 applies the pressure to the pressure-sensitive resistance sensor 301 becomes short. On the other hand, in the case where the remaining toner amount is small, as shown in (e) of FIG. 2, the time when the toner 28 is interposed between the pressure-applying portion 341 and the pressure-sensitive resistance sensor 301 is short and therefore the time duration for which the pressure-applying portion 341 applies the pressure to the pressure-sensitive resistance sensor 301 becomes long. In this embodiment, the remaining toner amount is detected by using this principle.

[Circuit Constitution of Remaining Toner Amount Detection]

Part (a) of FIG. 4 is a circuit diagram in in which a change in resistance value of the pressure-sensitive resistance sensor 301 is detected by a voltage inputted into an A/D port of CPU 40. A resistor 37 is a fixed resistor. A power source voltage of DC 3.3 V is divided by a resistance value of the pressure-sensitive resistance sensor 301 changed in resistance value by the applied pressure and a resistance value of the resistor 37, thus being inputted into the A/D port of the CPU 40.

[Detection Characteristic of Remaining Toner Amount]

Next, a detection characteristic of the remaining toner amount measured by using the circuit of (a) of FIG. 4 in this embodiment will be described. Part (b) of FIG. 4 is a characteristic graph showing a corresponding relation between the remaining toner amount and a time of a sensor on-state of the pressure-sensitive resistance sensor 301, in which the ordinate represents the time (msec) and the abscissa represents the remaining toner amount (%). Part (c) of FIG. 4 is a graph showing a voltage waveform inputted into the A/D port of the CPU 40 at the time when the remaining toner amount is 60% in (b) of FIG. 4. In (c) of FIG. 4, the ordinate represents an AD port input voltage (V) and the abscissa represents the time (msec), and (c) of FIG. 4 shows that the pressure-sensitive resistance sensor 301 is in the on-state for 114 milliseconds. From (c) of FIG. 4, it is understood that the pressure-sensitive resistance sensor 301 is in the on-state from the time when the pressure-applying portion 341 directly applies the pressure to the pressure-sensitive resistance sensor 301 to the time when the toner 28 is started to gradually function as the buffering member between the pressure-applying portion 341 and the pressure-sensitive resistance sensor 301. On the other hand, in a period in which the toner 28 functions as the buffering member and when the pressure-applying portion 341 passes through a region other than the region of the pressure-sensitive resistance sensor 301, the pressure-sensitive resistance sensor is in an off-state. Part (d) of FIG. 4 is a table T obtained by tabulating the corresponding relation between the sensor on-time (msec) of the pressure-sensitive resistance sensor 301 and the remaining toner amount (%) from the characteristic graph of (b) of FIG. 4. The remaining toner amount corresponding to the sensor on-time which is not explicitly shown in the table T can be obtained by linear interpolation of the known remaining amount of the toner 28 listed in the table T. Here, the measured sensor on-time of the pressure-sensitive resistance sensor 301 is a measured value in this embodiment and when a measuring condition is changed, a measured time is also changed. Further, this is also true for the numerical values in the table T from which the remaining amount of the toner 28 is discriminated.

[Sequence of Remaining Toner Amount Detection]

Then, a processing sequence of the remaining toner amount detection in this embodiment will be described by using a flow chart of FIG. 5. The processing shown in FIG. 5 is executed by the CPU 40 on the basis of a control program stored in the ROM of the storing portion, and each processing of flow charts in subsequent embodiments is similarly executed by the CPU 40. Incidentally, the whole processing shown in the flow chart is not always effected by the CPU 40 but, e.g., in the case where an application-specific integrated circuit (ASIC) is mounted in the image forming apparatus, a function of effecting any of processes in the flow chart may also be performed by the ASIC.

First, in a step 101 (S101) the CPU 40 rotates the polyester stirring film 34. In S102, the CPU 40 monitors the A/D port thereof, and reads an input voltage of the A/D port (sensor value reading) and also measures a retention time of a predetermined input voltage value by the timer. In S103, in order to detect an initial state in which the pressure is not applied to the pressure-sensitive resistance sensor 301, the CPU 40 discriminates from the input voltage value and the timer value whether or not a state in which the input voltage of 3.0-3.3 V into the A/D port is continued for not less than 0.5 sec. In the case where the continuation of the input voltage value of 3.0-3.3 V for not less than 0.5 sec is detected, the CPU 40 discriminates that the pressure-sensitive resistance sensor 301 is in normal operation and the sequence goes to S104, and when the continuation is not detected, the sequence goes to S115. In S115, the CPU 40 discriminates whether or not 2 sec or more elapses from start of the reading of the input voltage value without the continuation of the input voltage value of 3.0-3.3 V for not less than 0.5 sec. A period of the polyester stirring film 34 in this embodiment is about 1 sec, and in the case where the CPU 40 detects that 2 sec or more elapses from start of the input voltage value reading without the continuation of the input voltage value of 3.0-3.3 V for not less than 0.5 sec, the sequence goes to S114, and when the detection is not effected, the sequence is returned to S102. In S114, the CPU 40 discriminates abnormality of the pressure-sensitive resistance sensor 301 from the fact that the initial state in which the pressure is not applied to the pressure-sensitive resistance sensor 301 is not detected, and notifies the video controller 42 that the pressure-sensitive resistance sensor 301 is abnormal.

In S104, the CPU 40 reads the input voltage value of the A/D port. In S105, the CPU 40 discriminates whether or not the input voltage value is not more than 2.6 V and in the case where the input voltage value of not more than 2.6 V is detected, the sequence goes to S106, and in the case where the detection is not effected, the sequence goes to S116. In S116, the CPU 40 discriminates whether or not 2 sec or more elapses from the start of the input voltage value reading and in the case where the elapsed time is less than 2 sec, the sequence is returned to S104. In S116, in the case where the detection that 2 sec or more elapses is effected, the sequence goes to the processing of S114, in which the CPU 40 discriminates the abnormality of the pressure-sensitive resistance sensor 301 from the fact that only the initial stage in which the pressure is not applied is detected, and notifies the video controller 42 that the pressure-sensitive resistance sensor 301 is abnormal.

In S106, the CPU 40 recognizes falling of the signal of the pressure-sensitive resistance sensor (start of the on-state) and starts the timer in order to measure the time duration in which the pressure-sensitive resistance sensor 301 is in the on-state. Then, in S107, the CPU 40 reads the input voltage value of the A/D port. In S108, the CPU 40 discriminates whether or not the input voltage value is not less than 2.8 V and in the case where not less than 2.8 V is detected, the sequence goes to S109. In S108, in the case where the input voltage value is less than 2.8 V, the sequence goes to S113, in which the CPU 40 discriminates whether or not 2 sec or more elapses from the start of the timer. In the case of less than 2 sec, the sequence is returned to S0107. In S113, in the case where the detection that 2 sec or more elapses from the start of the timer is effected, the sequence goes to S114, in which the CPU 40 discriminates that the pressure-sensitive resistance sensor 301 is abnormal notifies the video controller 42 of the abnormality of the pressure-sensitive resistance sensor 301.

In S108, the CPU 40 recognizes rising of the signal of the pressure-sensitive resistance sensor 301 (end of the on-state) by detecting that the input voltage value of the A/D port is not less than 2.8 V, and in S109, the measurement of the time by the timer is stopped. The reason why a falling threshold of the input voltage value of the A/D port is 2.6 V in S105 and a rising threshold is 2.8 V in S108 is that an erroneous operation due to noise is prevented by providing hysteresis (a voltage difference between the thresholds). Then, in S110, the CPU 40 reads, from the timer, the timer when the pressure-sensitive resistance sensor 301 is in the on-state. In S111, the CPU 40 compares the read timer value with the sensor on-time in the table T stored in the ROM of the storing portion, thus calculating a corresponding remaining amount of the toner 28. Then, in S112, the CPU 140 notifies the video controller 42 of the remaining toner amount corresponding to the timer value. Thus, the CPU 40 measures the time duration of the detection of the pressure by the pressure-sensitive resistance sensor 301 by monitoring the input voltage into the A/D port, so that the remaining toner amount corresponding to the time duration can be calculated from the table T in real time.

In the above-described processing sequence, the detection of the falling edge of the signal of the pressure-sensitive resistance sensor 301 is effected after the input voltage into the A/D port is stabilized at 3.3 V but it is also possible that the detection of the falling edge is effected after a predetermined time elapses from the rotation start of the polyester stirring film 34.

Incidentally, in this embodiment, the CPU 40 detects the analog voltage value via the A/D port but may also detect the time duration via a digital port by constituting the voltage detecting circuit with a comparator or the like to digitalize the input voltage. Further, in this embodiment, only the detection of the time duration in which the pressure-sensitive resistance sensor 301 detects the pressure is required and therefore in place of the pressure-sensitive resistance sensor 301, a sheet switch (also called membrane switch) described later or a general-purpose pressure sensor may also be used.

As described above, according to this embodiment, the remaining toner amount can be detected in real time with a simple constitution irrespective of the amount of the toner and can be detected with high accuracy even when the stirring member is operated at high speed. That is, the detection of the remaining toner amount is made on the basis of the time duration in which the pressure-sensitive resistance sensor 301 detects the pressure and therefore the remaining toner amount can be detected in real time until the toner 28 is changed from a full state to an empty state. Further, by using the pressure-sensitive resistance sensor 301, the detecting circuit can be simplified and the reaction speed is fast and therefore speed-up of the detection time can also be realized. Further, the bending of the polyester stirring film 34 is stable depending on the remaining toner amount even when the polyester stirring film 34 is rotated at high speed and therefore the remaining amount detection of the toner 28 can be effected simultaneously with the image forming operation.

Embodiment 2

In Embodiment 1, on the basis of the time duration in which the pressure-sensitive resistance sensor 301 detects the pressure, the example in which the remaining toner amount is detected was described. In this embodiment, the resistance value of the pressure-sensitive resistance sensor 301 varies depending on the detected pressure and therefore an example in which the remaining toner amount is detected by detecting the change in voltage inputted into the A/D port of the CPU 40 will be described. Incidentally, the constitutions of FIGS. 1 to 3 and (a) of FIG. 4 described in Embodiment 1 are also applied to those in this embodiment. Further, the same constituent elements as those in Embodiment 1 are represented by the same reference numerals or symbols and are specifically described in Embodiment 1, thus being omitted from description in this embodiment.

[Detection Characteristic of Remaining Toner Amount]

Next, a detection characteristic of the remaining toner amount measured by using the circuit of (a) of FIG. 4 in this embodiment will be described. Part (a) of FIG. 6 is a characteristic graph showing a corresponding relation between the remaining amount of the toner 28 and an input voltage, of the A/D port of the CPU 40, divided by the resistance value of the pressure-sensitive resistance sensor 301 and the resistor 37, in which the ordinate represents the input voltage (V) and the abscissa represents the remaining toner amount (%). Further, (b) of FIG. 6 is a graph showing a voltage waveform inputted into the A/D port of the CPU 40 at the time when the remaining toner amount is 60% in (a) of FIG. 6. In (b) of FIG. 6, the ordinate represents an AD port input voltage (V) and the abscissa represents the time (msec), and (b) of FIG. 6 shows that an output voltage is 1.495 V when the pressure-sensitive resistance sensor 301 is in the on-state. Part (c) of FIG. 6 is a table N obtained by tabulating the corresponding relation between the input voltage value (V) of the A/D port of the CPU 40 and the remaining amount (%) of the toner 28 from the characteristic graph of (a) of FIG. 6. The remaining toner amount corresponding to the input voltage which is not explicitly shown in the table N can be obtained by linear interpolation of the known remaining amount of the toner 28 listed in the table N. Here, the measured input voltage value of the A/D port of the CPU 40 is a measured voltage value in this embodiment and when a condition is changed, the measured voltage value is also changed. Further, this is also true for the numerical values in the table N from which the remaining amount of the toner 28 is discriminated.

[Sequence of Remaining Toner Amount Detection]

Then, a processing sequence of the remaining toner amount detection in this embodiment will be described by using a flow chart of FIG. 7. The processing in S201 to S203, S214 and S215 in FIG. 7 is the same as that in S101 to S103, S115 and S114 in the flow chart of FIG. 5 and therefore will be omitted from description. In S203, in the case where the detection that the input voltage of the A/D port is 3.0-3.3 V continuously for not less than 0.5 sec is made, the sequence goes to S204, in which the CPU 40 calculates an average of the read input voltage values and the average is stored in the RAM in the storing portion as an initial value of the input voltage.

IN S205, the CPU 40 reads the input voltage of the A/D port in order to detect a start of the application of the pressure to the pressure-sensitive resistance sensor 301. In S206, the CPU 40 discriminates whether or not the voltage value is not more than the initial value (−0.4 V) and in the case of not more than the initial value (−0.4 V), the sequence goes to S207. In S206, in the case where the voltage value is higher than the initial value (−0.4 V), the CPU 40 discriminates that the pressure is not applied to the pressure-sensitive resistance sensor 301, so that the sequence goes to S212. In S212, the CPU 40 discriminates, after the processing of S204, whether or not the state in which the input voltage value is 3.0-3.3 V is continued for 2.0 sec or more and in the case where the state is not continued, the sequence is returned to S205. In S212, in the case where the CPU 40 discriminates that the state in which the input voltage value is 3.0-3.3 V is continued for 2.0 sec or more, the sequence goes to S213, in which the CPU 40 discriminates that the pressure-sensitive resistance sensor 301 is abnormal and notifies the video controller 42 of the abnormality of the pressure-sensitive resistance sensor 301.

In S207, the CPU 40 recognizes the start of the application of the pressure to the pressure-sensitive resistance sensor 301 by detecting that the input voltage value is not more than the initial value (−0.4 V) and performs continuous reading of the input voltage of the A/D port. The CPU 40 continues the input voltage reading in a period in which the input voltage value is within ±0.3 V of the initial value (−0.4 V), so that the read voltage value is once stored in the RAM. When the input voltage value is not within ±0.3 V of the initial value (−0.4 V), the sequence goes to S208. In S208, the CPU 40 discriminates that the input voltage reading is continued for 0.1 sec or more and when the input voltage reading is not continued, the sequence is returned to S205. In the case where the input voltage reading is continued, the CPU 40 discriminates that the read voltage value is normal, so that the sequence goes to S209. In S209, the CPU 40 calculates an average of voltage values accumulated in the RAM, and in S210, the CPU 40 compares the input voltage of the A/D port in the table N stored in the ROM with the calculated average. Then, in S211, the CPU 40 notifies, as a result of the comparison, the video controller 42 of the obtained remaining toner amount. Thus, the remaining toner amount is detected in real time by the voltage value on the basis of the change in resistance value corresponding to the pressure applied to the pressure-sensitive resistance sensor 301 by the pressure-applying portion 341 via the toner 28.

[Circuit Constitution of Remaining Toner Amount Detection]

In this embodiment, the voltage value inputted into the A/D port of the CPU 40 is determined by voltage division between the resistance value of the pressure-sensitive resistance sensor 301 and the voltage division resistor 37. For that reason, in average of the remaining toner amount from 100% to 0%, the resistance value of the voltage division resistor 37 is selected so that the input voltage value can be obtained without being saturated. In order to enhance detection accuracy when the remaining toner amount is small, the resistance value of the voltage division resistor 37 is selected so that the change in voltage with respect to the remaining toner amount is made further large, whereby sensitivity can be improved. In that case, the case where the input voltage value is saturated would be considered and therefore the circuit constitution such that the input voltage value is not saturated by switching the voltage division resistance value depending on the remaining toner amount would be considered. FIG. 8 is a schematic diagram showing a circuit constitution for switching the voltage division resistance value. In FIG. 8, an analog switch 39 is subjected to control of on/off state by an output from a digital output port DO of the CPU 40. The CPU 40 sets the analog switch 39 in the off-state in the case where the remaining toner amount is large and sets the analog switch 39 in the on-state in the case where the remaining toner amount is small (e.g., not more than 20%), thus making the change in voltage with respect to the remaining toner amount large. That is, in the case where the analog switch 39 is in the off-state, the voltage obtained by the voltage division between the resistance value of the pressure-sensitive resistance sensor 301 and the resistance value of the fixed resistor 37 is inputted into the A/D port of the CPU 40. In the case where the analog switch 39 is in the on-state, the fixed resistor 38 is connected in parallel to the fixed resistor 37, so that their combined resistance value is smaller than the resistance value of the fixed resistor 37 and therefore a voltage division ratio between itself and the resistance value of the pressure-sensitive resistance sensor 301 is changed and thus the change in voltage with respect to the remaining toner amount becomes large. However, in this case, in order to calculate the remaining amount of the toner 28 from the input voltage value, the table N of (c) of FIG. 6 cannot be used and therefore there is a need to provide a new corresponding table between the input voltage value and the remaining toner amount in the ROM of the storing portion in advance.

As described above, according to this embodiment, the remaining toner amount can be detected in real time with a simple constitution irrespective of the amount of the toner and can be detected with high accuracy even when the stirring member is operated at high speed. That is, the detection of the remaining toner amount is made on the basis of the time duration in which the pressure-sensitive resistance sensor 301 detects the pressure and therefore the remaining toner amount can be detected in real time until the toner is changed from a full state to an empty state. Further, the remaining toner amount is detected by the change in resistance value of the pressure-sensitive resistance sensor 301 corresponding to the pressure and therefore in the case where the remaining toner amount is not more than a predetermined amount (e.g., not more than 20%), the detection accuracy of the remaining toner amount can be enhanced by switching the fixed resistors shown in FIG. 8. Further, by using the pressure-sensitive resistance sensor 301, the detecting circuit can be simplified and the reaction speed is fast and therefore speed-up of the detection time can also be realized. Further, the bending of the polyester stirring film 34 is stable depending on the remaining toner amount even when the polyester stirring film 34 is rotated at high speed and therefore the remaining amount detection of the toner can be effected simultaneously with the image forming operation.

Embodiment 3

In Embodiment 1, on the basis of the time in which the pressure-sensitive resistance sensor 301 detects the pressure, the remaining toner amount was detected. In this embodiment, in place of the pressure-sensitive resistance sensor 301, a sheet switch 311 which is a switch element is used and the remaining toner amount is detected on the basis of the time in which the sheet switch 311 detects the pressure. Further, with timing when the sheet switch 311 does not detect the pressure, temperature detection of the process cartridge 5 is effected and on the basis of detected temperature data, control of an unshown cooling fan or the like is effected. Further, a temperature detection signal is incorporated from the A/D port via the same signal line as that for the remaining toner amount detection data. Incidentally, the constitutions of FIGS. 1 to 3 described in Embodiment 1 are also applied to those in this embodiment. However, the sheet switch 311 has the same shape as the pressure-sensitive resistance sensor 301 and is disposed at the same position as the pressure-sensitive resistance sensor 301. In this embodiment, the pressure-sensitive resistance sensor 301 in FIGS. 1 to 3 is replaced with the sheet switch 311. The sheet switch 311 in this embodiment includes, similarly as the pressure-sensitive resistance sensor 301, contact sheets of two layers (upper portion and lower portion), and a spacer is interposed at a periphery between the two layers to form a space (gap). The sheet switch 311 has a constitution such that the upper contact sheet surface is deformed, when the detection surface is pressed, to contact the lower contact sheet surface to establish electrical conduction. When the pressure of not less than a certain value is applied to the detection surface, irrespective of the magnitude of the pressure, the contact sheets are contacted to each other to be placed in an electrical conduction state, so that the resistance value becomes almost zero ohm. Further, the same constituent elements as those in Embodiment 1 are represented by the same reference numerals or symbols and are specifically described in Embodiment 1, thus being omitted from description in this embodiment.

[Circuit Constitution of Remaining Toner Amount Detection]

Figure 9A:
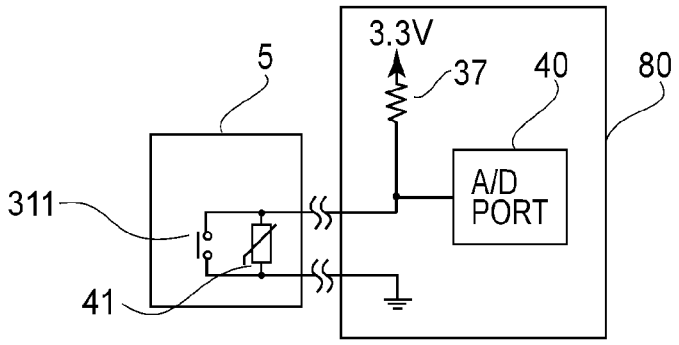

FIG. 9A is a circuit diagram in which a change in resistance value of the sheet switch 311 is detected. The sheet switch 311 detects the remaining amount of the toner 28 by the pressure of the toner 28, and a thermistor 41 detects the temperature of the process cartridge 5. Further, the sheet switch 311 and the thermistor 41 are connected in parallel.

[Detection Characteristic of Remaining Toner Amount]

Figure 9B:
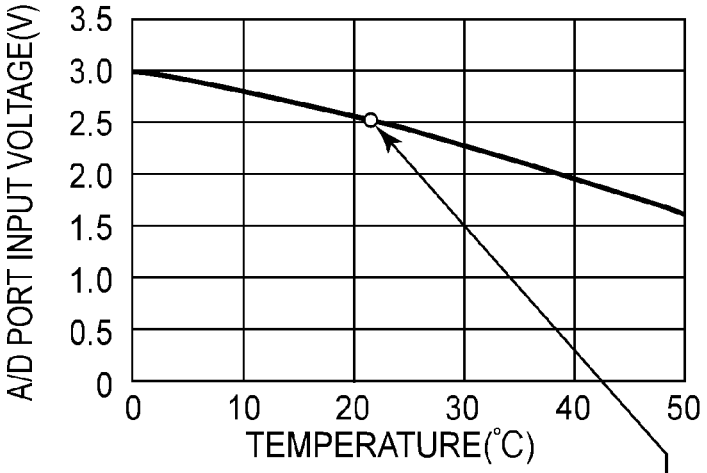
Figure 9C:
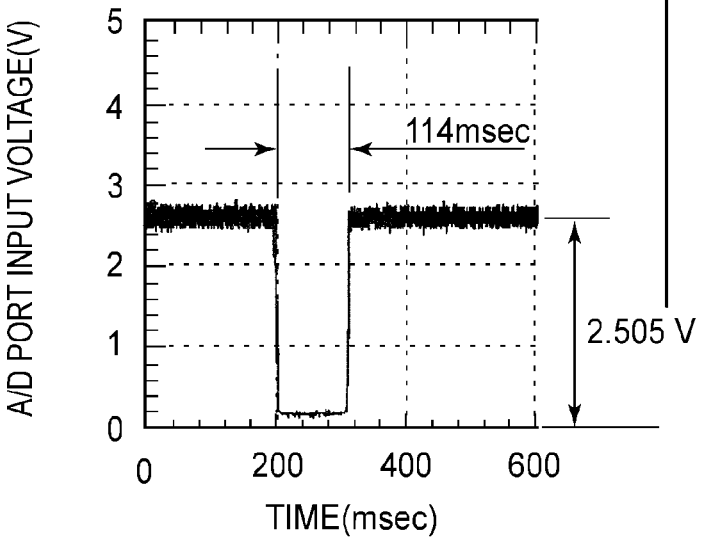

FIG. 9B is a characteristic graph showing a corresponding relation between the temperature of the process cartridge 5 with timing when the sheet switch 311 does not detect the pressure and an input voltage, of the A/D port of the CPU 40, divided by the resistance value of the thermistor 41 and the resistor 37. In FIG. 9B, the ordinate represents the input voltage (V) and the abscissa represents the temperature (° C.). FIG. 9C is a graph showing a voltage waveform inputted into the A/D port of the CPU 40 at the time when the temperature of the process cartridge 5 is 22° C. and the polyester stirring film 34 is rotated in FIG. 9B. In FIG. 9C, the ordinate represents an AD port input voltage (V) and the abscissa represents the time (msec), and FIG. 9C shows that an output voltage is 2.505 V in the case where the sheet switch 311 does not detect the pressure. FIG. 9D is a table Q obtained by tabulating the corresponding relation between the input voltage value (V) of the A/D port of the CPU 40 and the temperature (° C.) of the process cartridge 5 from the characteristic graph of FIG. 9B. The temperature corresponding to the input voltage which is not explicitly shown in the table Q can be obtained by linear interpolation of the known temperature of the process cartridge 5 listed in the table Q. Incidentally, the measured input voltage value of the A/D port of the CPU 40 is a measured value in this embodiment and when a condition is changed, the measured voltage value is also changed. Further, this is also true for the numerical values in the table Q from which the temperature of the process cartridge 5 is discriminated.

In FIG. 9C, it is understood that the temperature of the process cartridge 5 is 22° C. from the voltage of 2.505 V which is the detection result of the thermistor 41 and from the table Q. Further, in (c) of FIG. 9, it is understood that a time in which the sheet switch 311 detects the pressure and is in the on-state (a time in which the A/D port input voltage is at a low level (about 0.2 V)) is 114 msec and that the remaining amount of the toner 28 is 60% from the table T of (d) of FIG. 4. That is, the input voltage of the A/D port of the CPU 40 with timing when the sheet switch 311 does not detect the pressure is a detection result of the thermistor 41 and therefore on the basis of this value, the CPU 40 discriminates the temperature of the process cartridge 5. In a state in which the polyester stirring film 34 is rotated, the voltage value of the thermistor 41 can be detected by monitoring the voltage value after the timing when the pressure application of the polyester stirring film 34 to the sheet switch 311 is ended. However, the rising threshold and falling threshold of the sheet switch 311 are required to be, e.g., 1.3 V and 1.0 V which are smaller than a voltage output range of the thermistor 41.

[Sequence of Remaining Toner Amount Detection]

Then, the processing sequence of the remaining toner amount detection in this embodiment will be described by using a flow chart of FIG. 10. First, in S501, the polyester stirring film 34 is rotated. In S502, the CPU 40 reads the input voltage of the A/D port (sensor value reading) and measures the retention time of a predetermined input voltage value by the timer. In S503, the CPU 40 discriminates whether or not the thermistor 41 is operated normally from the input voltage value and the retention time. In S503, the CPU 40 discriminates whether or not a state in which the A/D port input voltage is not less than 1.5 V is continued for 0.5 sec or more and in the case where the state is continued for 0.5 sec or more, the sequence goes to S515. In S515, the CPU 40 discriminates whether or not the state in which the input voltage is less than 1.5 V is continued for 2.0 sec or more and in the case where the state is not continued, the sequence is returned to S502. In S515, in the case where the state in which the input voltage is less than 1.5 V is continued for 2.0 sec or more, the sequence goes to S516, in which the CPU 40 discriminates that the thermistor 41 is abnormal and then notifies the video controller 42 of the abnormality of the thermistor 41.

In S504, the CPU 40 discriminates that the thermistor 41 is operated normally and then calculates an average of the read input voltages in order to obtain the temperature of the process cartridge 5. Then, in S505, the CPU 40 compares the calculated average of the input voltages with the A/D port input voltage in the table Q, thus detecting the temperature of the process cartridge 5 corresponding to the input voltage. Next, in S506, the CPU 40 clears (resets) a timer value of the timer for remaining toner amount detection and then starts time measurement.

In S507, the CPU 40 reads the A/D port input voltage. In S508, the CPU 40 discriminates whether or not the read input voltage value is not more than 1.0 V and if the read input voltage value is not more than 1.0 V, the sequence goes to S509. If the read input voltage value is higher than 1.0 V, the CPU 401 clears the timer value of the timer for remaining toner amount detection and the sequence goes to S517, in which the CPU discriminates whether or not a state in which the input voltage value is higher than 1.0 V is continued for 2 sec or more. If the state is continued for less than 2 sec, the sequence is returned to S507. In S517, in the case where the state in which the input voltage value is higher than 1.0 V is continued for 2 sec or more, the sequence of the CPU 40 goes to S518, in which the CPU 40 discriminates that the sheet switch 311 as the sensor is abnormal and then notifies the video controller 42 of the abnormality of the sheet switch 311.

In S509, the CPU 40 detects that the input voltage is not more than 1.0 V and therefore the develop of the toner 28 is applied to the sheet switch 311. Thus, the CPU 40 discriminates that the sheet switch 311 is in the on-state, and continues the time measurement by the timer for remaining toner amount detection. Then, in S510, the CPU 40 reads the timer value from the timer and in the case where the CPU 40 discriminates that the timer value indicates not less than 1.0 sec, the sequence goes to S519, in which the CPU 40 discriminates that the sheet switch 311 is abnormal and then notifies the video controller 42 of the abnormality of the sheet switch 311. In S510, in the case where the CPU 40 discriminates that the timer value is less than 1.0 sec, the sequence of the CPU 40 goes to S511. In S511, the CPU 40 discriminates whether or not the A/D port input voltage is not less than 1.3 V and if the input voltage is not less than 1.3 V, the sequence goes to S512 and if the input voltage is less than 1.3 V, the sequence is returned to S507.

In S512, the CPU 40 discriminates that the sheet switch 311 is changed from the on-state to the off-state from the fact that the A/D port input voltage is not less than 1.3 V, and then reads the timer value for remaining toner amount detection. Next, in S513, the CPU 40 compares the sensor on-time in the table T stored in the ROM with the read timer value. In S514, as the result of comparison, the CPU 40 notifies the video controller 42 of the obtained remaining toner amount.

As described above, according to this embodiment, the remaining toner amount can be detected in real time with a simple constitution irrespective of the amount of the toner and can be detected with high accuracy even when the stirring member is operated at high speed. That is, also in this embodiment, the remaining toner amount detection accuracy equivalent to that in Embodiment 1 is obtained. Further, commonality of the signal lines of the temperature detection of the process cartridge and the signal lines of the sheet switch can be achieved and therefore compared with the case where the signal lines are separately provided, the number of the signal lines can be reduced by two lines. As a result, the lead lines and connectors can be reduced and in addition, the number of the A/D ports of the CPU 40 can be reduced, so that a cost can be reduced.

In this embodiment, as the temperature detecting sensor, the thermistor was used. The thermistor used in this embodiment is of the type in which the resistance value is decreased with temperature rise but a thermistor of the type in which the resistance value is increased with temperature rise is also applicable.

Further, in this embodiment, the sheet switch is used for the remaining amount detection of the toner but similarly as in Embodiments 1 and 2, the pressure-sensitive resistance sensor can also be used. However, the thermistor changes its resistance value with the temperature, and the pressure-sensitive resistance sensor also changes its resistance value with the pressure. For that reason, when the CPU 40 detects the remaining toner amount from the input voltage waveform into the A/D port, the remaining toner amount cannot be calculated from the input voltage value but there is a need to use the time duration, in which the pressure-sensitive resistance sensor detects the pressure, in order to calculate the remaining toner amount. Further, with respect to the temperature detection by the thermistor, it is possible to detect the temperature of the process cartridge through the table Q by detecting the voltage of the voltage waveform inputted into the A/D port in the on-state (with the timing when the pressure-sensitive resistance sensor does not detect the pressure).

Other embodiments will be described.

In Embodiment 1 to Embodiment 3, as shown in the circuit diagrams of the remaining toner amount detection, the signal line of the reference potential (ground) is provided between the control board 80 and the process cartridge 5, thus matching the reference potential. However, the process cartridge 5 and the main assembly 101 of the image forming apparatus are connected so that their potentials as the reference are equal to each other. Therefore, commonality of the reference potential of the control board 80 supplied via the signal line and the reference potential of the pressure-sensitive resistance sensor 301 or the sheet switch 311 can be achieved. As a result, the signal line provided between the control board 80 and the process cartridge 5 can be deleted, so that the cost can be reduced.

Further, in Embodiment 1 to Embodiment 3, the example in which the pressure-sensitive resistance sensor 301 or the sheet switch 311 is urged for converting the pressure to the voltage is described but in place of the pressure-sensitive resistance sensor or the sheet switch, other pressure sensors for converting the pressure to a current, a resistance value and a frequency can also be used.

Further, in Embodiment 1 to Embodiment 3, for easy understanding, the description such that the reference to the table was made for one detection was described. However, by averaging data obtained by the detection of plural times and then by comparing the data with corresponding tables, respectively, further enhancement of the detection accuracy can be expected.

Further, in Embodiment 1 to Embodiment 3, the developing unit having the constitution in which the developing roller 3 and the toner container 23 are integrally provided was taken as an example. However, also with respect to a supply-type toner container which is provided separately from the developing roller, by providing the pressure-sensitive resistance sensor and the polyester stirring film in the toner container, the present invention is applicable.

Embodiment 4

The constitutions of the image forming apparatus and the pressure-sensitive resistance sensor are the same as those in Embodiment 1 and therefore will be omitted from the description.

Part (a) of FIG. 11 is a perspective view of a process cartridge 5B. In a toner container 23B of the process cartridge 5B shown in (a) of FIG. 3, the following constitution is provided. A reference polyester film 30B of Mylar having small flexiblity is connected to a rotation shaft of the toner container 23B at its one end and is rotated about the rotation shaft in an arrow B direction at a rotational speed of about one full turn per sec (about one full turn/sec). In the neighborhood of a circumferential end of the reference polyester film 30B, a reference pressure-applying portion 300B having flexibility for applying the pressure to an end wall surface of the toner container 23B perpendicular to the rotation shaft in the container is provided. The reference polyester film 30B and the reference pressure-applying portion 300B constitute a first rotatable member. A longitudinal length of the reference polyester film 30B is required to be the same as that of the rotation shaft if the function of stirring a toner 28B is provided to the reference polyester film 30B. Further, if noise or the like is problematic, the length is required to be shortened. A radial length of the reference polyester film 30B is not required to be a length to the extent that the end of the reference polyester film 30B contacts the bottom of the toner container 23B.

Further, a stirring polyester film (Mylar) 34B for stirring the toner (not shown) in the toner container 23B is provided. Here, the stirring polyester film 34B is 150 μm in thickness and has flexiblity. The stirring polyester film 34B is provided to the rotation shaft in the toner container 23B with a phase deviated from that of the reference polyester film 30B by 180 degrees, and is rotated in the arrow B direction at a rotational speed of about one full turn per sec similarly as the reference polyester film 30B. Further, in the neighborhood of a circumferential end of the stirring polyester film 34B, the stirring polyester film 34B includes a stirring pressure-applying portion 341B having flexibility for applying the pressure to an end wall surface of the toner container 23B perpendicular to the rotation shaft in the container is provided. Here, the stirring pressure-applying portion 341B is constituted integrally with the stirring polyester film 34B and has the same flexiblity as the stirring polyester film 34 but may only be required to have flexibility and may also be attached to the stirring polyester film 34B as a separate member. The stirring polyester film and the stirring pressure-applying portion 341B constitute a second rotatable member. A longitudinal length of the stirring polyester film 34B is required to be the same as that of the rotation shaft. A radial length of the stirring polyester film 34B is required to stir the toner 28B even in a state of the toner 28B in a small amount and therefore is required to be a length to the extent that the end of the reference polyester film 30B is contacted to and bent against the bottom of the toner container 23B. A pressure-sensitive resistance sensor 301B is provided to a developing unit inner wall (inner wall of the toner container 23B) perpendicular to the rotation shaft and at a lower side of the rotation shaft, and detects the pressure applied by the reference pressure-applying portion 300B or the stirring pressure-applying portion 341A.

Parts (b) and (c) of FIG. 11 are sectional views of the developing unit shown in (a) of FIG. 11, wherein (b) shows the case where the remaining toner amount is relatively large and (c) shows the case where the remaining toner amount is relatively small. When the reference pressure-applying portion 300B reaches the pressure-sensitive resistance sensor 301B, the reference pressure-applying portion 300B applies the pressure to the pressure-sensitive resistance sensor 301B. Similarly, when the stirring pressure-applying portion 341B which is rotated reaches the pressure-sensitive resistance sensor 301B, the stirring pressure-applying portion 341B applies the pressure to the pressure-sensitive resistance sensor 301B. Further, in a period in which the stirring pressure-applying portion 341B is spaced from the pressure-sensitive resistance sensor 301B and then the reference pressure-applying portion 300B reaches the pressure-sensitive resistance sensor 301B, both of the reference pressure-applying portion 300B and the stirring pressure-applying portion 341B do not apply the pressure to the pressure-sensitive resistance sensor 301B. Similarly, in a period in which the reference pressure-applying portion 300B is spaced from the pressure-sensitive resistance sensor 301B and then the stirring pressure-applying portion 341B reaches the pressure-sensitive resistance sensor 301B, both of the reference pressure-applying portion 300B and the stirring pressure-applying portion 341B do not apply the pressure to the pressure-sensitive resistance sensor 301B.

As shown in (b) of FIG. 11, in the case the remaining toner amount is relatively large, the stirring polyester film 34B is largely bent by the toner 28B and therefore is largely deformed toward a rear side (upstream side) with respect to the rotational direction. On the other hand, the flexibility of the reference polyester film 30B is small and therefore the degree of the bending by the toner is small, so that the reference polyester film 30B is not largely deformed toward the rear side with respect to the rotational direction. Therefore, a time difference from a time when the reference pressure-applying portion 300B reaches the detection surface of the pressure-sensitive resistance sensor 301B until a time when the stirring pressure-applying portion 341B reaches the detection surface of the pressure-sensitive resistance sensor 301B is long. On the other hand, in the case where the remaining toner amount is relatively small, as shown in (c) of FIG. 11, the amount (degree) of the bending of the stirring polyester film 34B becomes small when compared with the case of (b) of FIG. 12 in which the remaining toner amount is relatively large. Therefore, a time difference from the time when the reference pressure-applying portion 300B reaches the detection surface of the pressure-sensitive resistance sensor 301B until the time when the stirring pressure-applying portion 341B reaches the detection surface of the pressure-sensitive resistance sensor 301B is short. The time when the reference pressure-applying portion 300B or the stirring pressure-applying portion 341B refers to a time when each of the reference pressure-applying portion 300B and the stirring pressure-applying portion 341B starts application of pressure of not less than a certain value to the pressure-sensitive resistance sensor 300B. By using this principle, the remaining toner amount is detected. Part (d) of FIG. 11 is a circuit diagram of remaining toner amount detection.

A voltage obtained by dividing a power source voltage of DC 3.3 V of the pressure-sensitive resistance sensor 301B and a voltage division resistor 37B is inputted into the A/D port of a CPU 40B.

[Detection Characteristic of Remaining Toner Amount]

Next, a detection characteristic of the remaining toner amount detection in this embodiment will be described. Part (b) of FIG. 4 is a characteristic graph showing a corresponding relation between the remaining toner amount (%) and a sensor on-time difference (msec) from the time when the reference pressure-applying portion 300B reaches the detection surface of the pressure-sensitive resistance sensor 301B until the time when the stirring pressure-applying portion 341B reaches the detection surface of the pressure-sensitive resistance sensor 301B. Part (b) of FIG. 12 is a graph showing a relationship between the A/D port input voltage value (V) when the remaining toner amount is 40% and the time (msec). The reference pressure-applying portion 300B turns on the pressure-sensitive resistance sensor 301B for about 320 msec. Then, the stirring pressure-applying portion 341B turns on the pressure-sensitive resistance sensor 301B for about 120 msec. On the other hand, in a state in which the reference pressure-applying portion 300B or the stirring pressure-applying portion 341B is not located in the region of the pressure-sensitive resistance sensor 301B, the pressure-sensitive resistance sensor 301B is turned off. The time difference from the time when the reference pressure-applying portion 300B reaches the detection surface of the pressure-sensitive resistance sensor 301B until the time when the stirring pressure-applying portion 341B reaches the detection surface of the pressure-sensitive resistance sensor 301B is 544 msec. Part (c) of FIG. 12 is a table T showing a relationship between the sensor on-time difference (msec) and the remaining toner amount (&). The data in this table T are stored in the storing portion of the control board 80. The remaining toner amount which is not shown in the table T can be obtained by linear interpolation of the known remaining amount of the toner 28 listed in the table T. Here, the calculated time is a value in this embodiment and when a condition is changed, the calculated time is also changed. This is also true for the numerical values in the table from which the remaining toner amount (%) is calculated.

[Flow Chart of Remaining Toner Amount Detection]

Then, a procedure of the remaining toner amount detection in this embodiment will be described by using a flow chart of FIG. 13. Each processing of flow charts in subsequent embodiments is similarly executed by the CPU 40B. However, the present invention is not limited thereto but, e.g., in the case where an application-specific integrated circuit (ASIC) is mounted in the image forming apparatus, a function of any of steps may also be performed by the ASIC.

In S101B (step 101B), the CPU 40B starts rotation of the reference polyester film 30B and the stirring polyester film 34B. Next, in S102B to S108B, the CPU 40B detects the reference pressure-applying portion 300B of two pressure-applying portions. This is because the table T from which the remaining toner amount is discriminated is based on the time difference from the time when the reference pressure-applying portion 300B is detected until the time when the stirring pressure-applying portion 341B is detected. The CPU 40B compares a time difference from a first detection of a voltage which is not more than a falling threshold until a first detection time of a voltage which is a rising threshold with a time difference from a second detection time of the voltage which is not more than the falling threshold until a second detection time of the voltage which is not more than the rising threshold. In this embodiment, a longer time difference corresponds to a time difference from the time when the reference pressure-applying portion 300B reaches until the time when the reference pressure-applying portion 300B is spaced. The CPU 40B measures the time difference from the detection time of the voltage which is not more than the falling threshold until the detection time of the voltage which is not more than the rising threshold by using a timer, and compares the measured time difference with a desired time, so that the CPU 40B can detect the reference pressure-applying portion 300B.

In S102B, the CPU 40B resets the timer and then starts monitoring of the A/D port input voltage by using the circuit shown in (d) of FIG. 11. In S103, the CPU 40B discriminates whether or not the A/D port input voltage value is not more than 2.0 V. This is because timing when either one of the reference pressure-applying portion 300B and the stirring pressure-applying portion 341B starts application of the pressure to the detection surface of the pressure-sensitive resistance sensor 301A is detected, the falling threshold of a signal waveform of the monitored voltage is set at 2.0 V. When the A/D port input voltage value is not more than 2.0 V, the CPU 40B detects that either one of the reference pressure-applying portion 300B and the stirring pressure-applying portion 341B reaches the pressure-sensitive resistance sensor 301B and then starts the timer. In the case where the A/D port input voltage value is larger than 2.0 V, the processing of S103B is repeated. Next, in S105B, the CPU 40B discriminates whether or not the A/D port input voltage value is not less than 2.3 V. Here, the reason why the falling threshold is 2.0 V and the rising threshold is 2.3 V is that an erroneous operation due to noise is prevented by providing hysteresis.

The CPU 40B discriminates, in the case where it discriminates that the A/D port input voltage value is not less than 2.3 V in S105B, whether or not the timer value is not less than 300 msec and not more than 400 msec in S107B. Incidentally, in the case where the A/D port input voltage value is not 2.3 V or more, the CPU 40B discriminates whether or not 3 sec or more elapses from after the start of the timer in S106B. In the case where 3 sec or more does not elapse from after the start of the timer, the processing of S105B is repeated. Further, in S106B, in the case where 3 sec or more elapses from after the start of the timer, the CPU 40B discriminates that the sensor is abnormal and then notifies the video controller 42B of the abnormality of the sensor in S115B. In S107B, in the case where the timer value is not less than 300 msec and not more than 400 msec, the CPU 40B detects in S108B that the reference pressure-applying portion 300B is spaced from the pressure-sensitive resistance sensor 301B. A range in which the reference pressure-applying portion 300B applies the pressure to the pressure-sensitive resistance sensor 301B during rotation of 360 degrees, i.e., one full circumference, is about 120 degrees which corresponds to about 330 msec. On the other hand, the stirring pressure-applying portion 341B has the flexible larger than the reference pressure-applying portion 300B and therefore in the case where the toner is interposed between the stirring pressure-applying portion 341B and the pressure-sensitive resistance sensor 301B, the stirring pressure-applying portion 341B does not apply the pressure to the pressure-sensitive resistance sensor 301B. Therefore, the time when the stirring pressure-applying portion 341B applies the pressure to the pressure-sensitive resistance sensor 301B is smaller than 300 msec and is about 120 msec in this embodiment. In S107B, in the case where the CPU 40B discriminates that the timer value is within the above-described range, the CPU 40 discriminates in S108B that the reference pressure-applying portion 300B is spaced from the pressure-sensitive resistance sensor 301B. When the toner value is out of the above-descried range, the CPU 40B detects the stirring pressure-applying portion 341B and thus discriminates that the reference pressure-applying portion 300B cannot be detected. Thereafter, the sequence is returned to S102B, in which the CPU 40B resets the timer and then starts the monitoring of the A/D port input voltage value again.

In S109B, the CPU 40B discriminates whether or not the A/D port input voltage value is not more than 2.0 V. This is because whether or not the stirring pressure-applying portion 341B reaches the pressure-sensitive resistance sensor 301B is discriminated. In the case where the A/D port input voltage value is not 2.0 V or less in S109B and 3 sec or more elapses from after the start of the timer in S110B, the CPU 40B discriminates that the sensor is abnormal and then notifies the video controller 42 of the abnormality of the sensor in S115B. In the case where the A/D port input voltage value is not 2.0 V or less in S109B and 3 sec or more does not elapse from after the start of the timer, the CPU 40B repeats the processing of S109B. In S109B, in the case where the A/D port input voltage value is not more than 2.0 V, the CPU 40B detects in S111B that the stirring pressure-applying portion 341B reaches the pressure-sensitive resistance sensor 301B, and then stops the timer. In S112B, the CPU 40B reads the timer value. In S113B, the CPU 40B compares the timer value with values in the table T stored in the storing portion, thus detecting the remaining toner amount. In S114B, the CPU 40B notifies the video controller 42B of the detected remaining toner amount.

In this embodiment, in the remaining toner amount detection sequence, the reference polyester film 30B and the stirring polyester film 34B are rotated but, also during the image forming operation, the remaining toner amount can be detected when the reference polyester film 30B and the stirring polyester film 34B are rotated. Further, these polyester films are rotated several full turns before the remaining toner amount is detected and then in a state in which rotation states of the reference polyester film 30B and the stirring polyester film 34B are stabilized, the remaining toner amount detection may also be started. Further, although the remaining toner amount is calculated on the basis of the result of measurement of one time in this embodiment, the measurement is made plural times and then the remaining toner amount is detected from an average of the measured values, so that the accuracy of the remaining toner amount detection can be improved. Here, each of the defined rising threshold and falling threshold and the timer values are an example in the constitution in this embodiment. Each of the values is determined by totally taking into consideration the arrangements of the reference pressure-applying portion 300B and the stirring pressure-applying portion 341B, the rotational speeds of the reference polyester film 30B and the stirring polyester film 34B, a circuit constant, the output of the pressure-sensitive resistance sensor 301B, and the like and therefore is not limited to those described above.

Thus, by detecting the remaining toner amount on the basis of the time difference from the time when the reference pressure-applying portion 300B reaches the detection surface of the pressure-sensitive resistance sensor 301B until the time when the stirring pressure-applying portion 341B reaches the detection surface of the pressure-sensitive resistance sensor 301B, the remaining toner amount can be detected in real time from a full state to an empty state of the toner.

Further, by using the pressure-sensitive resistance sensor 301, the detecting circuit can be simplified and the reaction speed is fast and therefore shortening of the detection time can also be realized. Further, the bending of the polyester stirring film 34 is stable depending on the remaining toner amount even when the polyester stirring film 34 is rotated at high speed and therefore the remaining amount detection of the toner 28 can be effected simultaneously with the image forming operation.

Incidentally, according to this embodiment, the input voltage into the A/D port of the CPU 40B was detected. However, digitalization is achieved by constituting the voltage detecting circuit with the comparator or the like, and then the time may also be detected at a digital port. Further, the timing when the pressure is started to be applied may only be required to be detected and therefore in place of the pressure-sensitive resistance sensor, the sheet switch (membrane switch) (described in another embodiment) or a general-purpose pressure sensor may also be used. Further, a function of stirring the toner may also be performed by a detection polyester film (Mylar). As a result, the constitution in the developing unit can be simplified. Further, the example in which the stirring polyester film 34B is provided by being deviated in phase from the reference polyester film 30B by 180 degrees is shown but may also be deviated by other angles if it is disposed so that the time difference with respect to the pressure-applying portions can be detected with no overlapping between the reference pressure-applying portion 300B and the stirring pressure-applying portion 341B.

According to this embodiment, the remaining toner amount can be detected in real time from the full state to the empty state of the toner, and even when the stirring member is operated at high speed, the remaining toner amount can be detected with high accuracy.

Embodiment 5

In Embodiment 4, on the basis of the time difference in which the pressure-sensitive resistance sensor 301 detects the pressure, the remaining toner amount was detected. In this embodiment, the remaining toner amount is detected by detecting a difference in A/D port input voltage (a detect in output level) on the basis of a change in resistance value corresponding to the pressure detected by the pressure-sensitive resistance sensor 301B. Incidentally, the constitutions of the image forming apparatus, the pressure-sensitive resistance sensor and (a) to (c) of FIG. 11 and the circuit diagram in (d) of FIG. 11 described in Embodiment 4 are also applied to those in this embodiment. Further, the same constituent elements as those in Embodiment 4 are represented by the same reference numerals or symbols and will be omitted from description.

Next, a detection characteristic of the remaining toner amount in this embodiment will be described with reference to FIG. 14.

[Detection Characteristic of Remaining Toner Amount]

Part (a) of FIG. 14 is a characteristic graph showing a relationship between the remaining toner amount (%) and a voltage difference (A/D port input voltage difference (V)) between voltages inputted into the A/D port of the CPU 40B on the basis of the reference pressure-applying portion 300B and the stirring pressure-applying portion 341B, respectively. Part (b) of FIG. 14 is a graph of waveform data showing a relationship between the A/D port input voltage (V) and the time (msec) when the remaining toner amount is 40%. The A/D port input voltage during the turning-on of the pressure-sensitive resistance sensor 301B by the reference pressure-applying portion 300B is 0.2 V. On the other hand, the A/D port input voltage during the turning-on of the pressure-sensitive resistance sensor 301B by the stirring pressure-applying portion 341B is 0.85 V. Part (c) of FIG. 14 is a table N showing a relationship between the A/D port input voltage difference (V) and the remaining toner amount (%), and the table N is stored in the storing portion of the control board 80. The remaining toner amount between numerical values in the table N is obtained by linear interpolation of the known remaining toner amount. Here, the calculated value of the voltage difference is a value in this embodiment and when a condition is changed, the calculated value is also changed. This is also true for the numerical values in the table N from which the remaining toner amount is discriminated.

The remaining toner amount is not discriminated only by the A/D port input voltage by stirring pressure-applying portion 341B but is discriminated from the voltage difference between the A/D port input voltages by the reference pressure-applying portion 300B and the stirring pressure-applying portion 341B, so that the influence of variation in resistance value of the pressure-sensitive resistance sensor 301B can be reduced. Therefore, it becomes possible to detect the remaining toner amount with higher accuracy. In this embodiment, the resistance value of the voltage division resistor 37B is selected so that the voltage inputted by the voltage division between the pressure-sensitive resistance sensor 301B and the voltage division resistor 37B can be obtained, without being saturated, in the entire range of the remaining toner amount from 100% to 0%. Incidentally, in order to enhance the detection accuracy of the remaining toner amount, the resistance value of the voltage division resistor 37B may also be selected so that the change in voltage with respect to the remaining toner amount can be made further large. In that case, the voltage division resistance may be switched depending on the remaining toner amount so that the inputted voltage is not saturated.

[Flow Chart of Remaining Toner Amount Detection]

Then, a flow of the remaining toner amount detection in this embodiment will be described with reference to FIG. 15. The flow chart of the remaining toner amount detection in this embodiment and the flow chart in Embodiment 4 include common steps and therefore only different steps will be described below. Incidentally, S101B to S103B in FIG. 14 of Embodiment 4 correspond to S201B to S203B in FIG. 16 of this embodiment, S105B to S109B correspond to S206B to S210B, and S115B is identical to S220B and therefore these steps will be omitted from description.

In S203B, in the case where the CPU 40B discriminates that the A/D port input voltage value is not more than 2.0 V, the CPU 40B detects that the reference pressure-applying portion 300B or the reference pressure-applying portion 341B reaches the pressure-sensitive resistance sensor 301B, thus starting the timer and monitoring of the voltage value. In Embodiment 1, this monitoring of the voltage value was not effected. In S205B, the CPU 40B measures the input voltage value of the A/D port plural times and calculates an average. In this case, the CPU 40B regards values in a state in which a change amount of voltage values monitored at the A/D port at a measuring interval for the A/D port is not more than 0.3 V, as effective values, and calculates an average A of the voltage values in this state.

Incidentally, in the case where the CPU 40B discriminates that the timer value does not fall within the range of not less than 300 msec and not more than 400 msec, the sequence is returned to S202B and the CPU 40B calculates the average A again in S204B and S205B.

In S210B, in the case where the CPU 40B discriminates that the A/D port input voltage value is not more than 2.0 V, the CPU 40B discriminates that the stirring pressure-applying portion 341B reaches the pressure-sensitive resistance sensor 301B and starts monitoring of the voltage value of the case where the stirring pressure-applying portion 341B applies the pressure to the pressure-sensitive resistance sensor 301B. In S213B, the CPU 40B measures the A/D port input voltage value plural times to calculate an average B. In this case, the CPU 40B regards values in a state in which a change amount of voltage values monitored at the A/D port at a measuring interval for the A/D port is not more than 0.3 V, as effective values, and calculates the average B of the voltage values in this state. Next, in S214V, the CPU 40B discriminates whether or not the A/D port input voltage value is not less than 2.3 V. This is because the spacing of the stirring pressure-applying portion 341B from the pressure-sensitive resistance sensor 301B is discriminated. Incidentally, this discrimination is not made in Embodiment 1. In the case where the A/D port input voltage value is not 2.3 V or more, the CPU 40B discriminates whether or not 3 sec or more elapses from after the start of the timer in S215B. In the case where 3 sec or more does not elapse from after the start of the timer, the processing of S214B is repeated. In the case where 3 sec or more elapses from after the start of the timer, the CPU 40B discriminates that the sensor is abnormal and then notifies the video controller 42B of the abnormality of the sensor in S220B. In S214B, in the case where the A/D port input voltage value is not more than 2.3 V, the CPU 40B detects in S216B that the stirring pressure-applying portion 341B is spaced from the pressure-sensitive resistance sensor 301B. Next, in S217B, the CPU calculates a difference between the already-calculated averages A and B. Then, in S218B, the CPU 40B compares this difference between the averages A and B with values in the table N, thus detecting the remaining toner amount.

In this embodiment, the resistance value of the voltage division resistor 37B is selected so that the voltage value inputted by voltage division between the pressure-sensitive resistance sensor 301B and the voltage division resistor 37B can be obtained without being saturated in the entire range of the remaining toner amount from 100% to 0%. In order to enhance detection accuracy (sensitivity) in the case where the remaining toner amount is small or not more than a predetermined amount, the resistance value of the voltage division resistor 37B may also be selected so that the change in voltage with respect to the remaining toner amount is made further large. In that case, the voltage division resistance value may be switched depending on the remaining toner amount so that the inputted voltage is not saturated. Description will be made below with reference to the drawings. FIG. 16 is a circuit diagram for switching the voltage division resistance value. An analog switch 39B is turned on and off by a signal from the digital output part DO of the CPU 40. When the analog switch 39 is turned off the fixed resistor 38B is connected in parallel to the voltage division resistor 37B, so that the voltage division ratio to the pressure-sensitive resistance sensor 301B is changed.

Thus, by detecting the remaining toner amount through the detection of the output voltage difference on the basis of the resistance value corresponding to the pressure detected by the pressure-sensitive resistance sensor 301B, the remaining toner amount can be detected in real time from a full state to an empty state of the toner. Further, by using the pressure-sensitive resistance sensor 301, the detecting circuit can be simplified and the reaction speed is fast and therefore speed-up of the detection time can also be realized. Further, the bending of the polyester stirring film 34 is stable depending on the remaining toner amount even when the polyester stirring film 34 is rotated at high speed and therefore the remaining amount detection of the toner 28 can be effected simultaneously with the image forming operation.

According to this embodiment, the remaining toner amount can be detected in real time from the full state to the empty state of the toner, and even when the stirring member is operated at high speed, the remaining toner amount can be detected with high accuracy.

Embodiment 6

In Embodiment 4, the reference polyester film 30B has the flexibility and is bent by the resistance of the toner 28B, and the pressure-sensitive resistance sensor 301B detects from the time when the pressure is started to be applied thereto by the reference pressure-applying portion 300B until the time when the pressure is started to be applied thereto by the stirring pressure-applying portion 341B. In this embodiment, as shown in FIG. 17, in place of the reference polyester film 30B, a reference shaft 43B which is formed of a material having rigidity and which also has the function of stirring the toner 28B is provided in the developing unit. Further, in the neighborhood of a circumferential end of the reference shaft 34B, the reference pressure-applying portion 300B having the flexiblity for applying the pressure to the end portion wall surface perpendicular to the rotation shaft in the developing unit is provided. In this embodiment, the pressure-sensitive resistance sensor 301B detects from a time when the pressure is started to be applied thereto by the reference pressure-applying portion 300B of the reference shaft 43B until a time when the pressure is started to be applied thereto by the stirring pressure-applying portion 341B of the stirring polyester film 34B. A flow chart and detection characteristic in this embodiment are similar to those in Embodiment 4. The reference shaft 43B has high rigidity and therefore is constantly rotated irrespective of the remaining toner amount. For that reason, the reference shaft 43B is rotated by a certain distance irrespective of the remaining toner amount and therefore timing when the reference pressure-applying portion 300B reaches the pressure-sensitive resistance sensor 301B is constant irrespective of the remaining toner amount. Therefore, the remaining toner amount can be detected with higher accuracy.

According to this embodiment, the remaining toner amount can be detected in real time from the full state to the empty state of the toner, and even when the stirring member is operated at high speed, the remaining toner amount can be detected with high accuracy.

Embodiment 7

In Embodiment 6, the reference polyester film 30B has the flexible and is bent by the resistance of the toner 28B, and the pressure-sensitive resistance sensor 301B detects the value of the pressure applied thereto by the reference pressure-applying portion 300B and the value of the pressure applied thereto by the stirring pressure-applying portion 341B. Then, the remaining toner amount is detected on the basis of the A/D port input voltage difference based on the difference of these pressure values. In this embodiment, as shown in FIG. 17, similarly as in Embodiment 6, in place of the reference polyester film 30B, a reference shaft 43B which is formed of a material having high rigidity and which also has the function of stirring the toner 28B is provided in the developing unit. The constitution in the developing unit is similar to that in Embodiment 6. In this embodiment, the pressure-sensitive resistance sensor 301B detects the value of the pressure applied thereto by the reference pressure-applying portion 300B of the reference shaft 43B until and the value of the pressure applied thereto by the stirring pressure-applying portion 341B of the stirring polyester film 34B. A flow chart and detection characteristic in this embodiment are similar to those in Embodiment 5. The reference shaft 43B has high rigidity and therefore is constantly rotated irrespective of the remaining toner amount. For that reason, the reference shaft 43B is rotated by a certain distance irrespective of the remaining toner amount and therefore the value of the pressure applied from the reference pressure-applying portion 300B to the pressure-sensitive resistance sensor 301B is constant irrespective of the remaining toner amount. Therefore, the remaining toner amount can be detected with higher accuracy.

According to this embodiment, the remaining toner amount can be detected in real time from the full state to the empty state of the toner, and even when the stirring member is operated at high speed, the remaining toner amount can be detected with high accuracy.

Embodiment 8

In Embodiment 4, on the basis of the time in which the pressure-sensitive resistance sensor 301 detects the pressure, the remaining toner amount was detected, and on the other hand, in this embodiment, by the change in time when a sheet switch 311B which is a switch element detects the pressure, the remaining toner amount is detected. Further, with timing when the sheet switch 311B does not detect the pressure, the temperature of the process cartridge 5 is detected. The temperature data of the process cartridge 5 is used for control of an unshown cooling fan or the like. Commonality of a signal line for detecting the temperature and a signal line for detecting the remaining toner amount is a characteristic feature of the image forming apparatus in this embodiment. Incidentally, the constitutions of the image forming apparatus, the pressure-sensitive resistance sensor and (a) to (c) of FIG. 11 described in Embodiment 4 are also applied to those in this embodiment. However, the pressure-sensitive resistance sensor 301B is replaced with the sheet switch 311B. These have the substantially same shape and are disposed at the same position. The sheet switch 311B in this embodiment includes wiring patterns, and a spacer is interposed at a periphery between the two layers to form a space (gap). The sheet switch 311B has a constitution such that the upper wiring pattern surface is deformed, when the detection surface is pressed, to contact the lower wiring pattern surface. In such a constitution, when the pressure of not less than a certain value is applied to the detection surface, irrespective of the magnitude of the pressure, the resistance value becomes almost zero ohm, and the substantially same voltage is outputted. Further, the same constituent elements as those in Embodiment 1 are represented by the same reference numerals or symbols and will be omitted from description.

FIG. 18 is a circuit diagram in which a change in resistance value of the sheet switch 311B is detected. The sheet switch 311B detects the pressure of the toner 28B to detect the remaining toner amount, and a thermistor 41B detects the temperature of the process cartridge 5. FIG. 19A is a characteristic graph showing a relationship between the temperature (° C.) and the A/D port input voltage (V), inputted into the A/D port of the CPU 40B, obtained by voltage division between the thermistor 41B and the voltage division resistor 37B. A white circle represents the temperature of 22° C. FIG. 19 shows a waveform of a lapse of time (msec) of the A/D port input voltage (V) inputted into the A/D port of the CPU 40B when the reference polyester film 30B and the stirring polyester film 34B are rotated. In a state in which the reference polyester film 30B and the stirring polyester film 34B do not apply the pressure to the sheet switch 311B, the A/D port input voltage is 2.505 V, and the temperature in this state is 22° C. from a table Q. FIG. 19C is the table Q obtained by tabulating the characteristic between the temperature (° C.) and the A/D port input voltage (V) obtained by voltage division between the thermistor 41B and the voltage division resistor 37B. The table Q is stored in the storing portion of the control board 80B. The remaining toner amount between numerical values in the table is obtained by linear interpolation of the already-known remaining toner amount. In this case, the temperature of the process cartridge 5 is 22° C. and a time difference between falling times of the reference polyester film 30B and the stirring polyester film 34B is 544 msec and therefore the remaining toner amount is 40% from the table T. As the table showing the relationship between the sensor on-time difference (msec) and the remaining toner amount (%), reference to the table T is made. As the relationship between the temperature and the detection result of the thermistor 41B, reference to the table Q is made.

The input voltage of the A/D port of the CPU 40B with timing when the sheet switch 311B does not detect the pressure is the detection result of the thermistor 41B and therefore on the basis of this value (2.505 V in this case), the CPU 40B discriminates the temperature of the process cartridge 5. In the state in which the reference polyester film 30B and the stirring polyester film 34B are rotated, the voltage value of the thermistor 41B can be detected by monitoring the A/D port input voltage after detection of the timing when the pressure application of the detect polyester film 30B or the stirring polyester film 34F to the sheet switch 311B is ended. However, the rising threshold and falling threshold of the sheet switch 311B are required to be, e.g., 1.5 V and 1.8 V which are smaller than a voltage output range of the thermistor 41B.

[Flow Chart of Remaining Toner Amount Detection and Temperature Detection]

FIG. 20 is a flow chart in this embodiment. First, in S501B, the CPU 40B rotates the reference polyester film 30B and the stirring polyester film 34B. In S502B, the CPU 40B starts the timer to start the monitoring of the A/D port input voltage. The CPU 40B discriminates in S503B whether or not a time when the input voltage is not less than 1.5 V continues for 0.5 sec or more in order to detect an initial value (used for the temperature detection) of the A/D port input voltage when the pressure is not applied to the sheet switch 311B. In the case where the CPU 40B discriminates that the time is continued, the CPU 40 stores an average of the voltage values in 0.5 sec in S504B and then compares the average with the table Q in S505B to detect the temperature of the process cartridge 5. Thus, in this embodiment, the temperature is detected by using the temperature 41B in the state in which the pressure is not applied to the sheet switch 311B. In S503B, in the case where the CPU 40B discriminates that the time when the input voltage is not less than 1.5 V does not continue for 0.5 sec or more, in S517B, the CPU 40B discriminates whether or not 3 sec or more elapses. In the case where the CPU 40B discriminates that 3 sec or more does not elapse, the sequence is returned to S503B. Further, in the case where the CPU 40B discriminates that 3.0 sec or more elapses, in S520B, the CPU 40B discriminates that the thermistor is abnormal and notifies the video controller 42 of the abnormality of the thermistor.

The remaining steps S506B to S516B are substantially same as the steps S102B to S514B of the flow chart of FIG. 14 in Embodiment 4 and therefore only polyester films will be described. In S507B and S512B, the CPU 40B discriminates whether or not the A/D port input voltage is not more than 1.0 V, and in S509B, the CPU 40B discriminates whether or not the A/D port input voltage is not less than 1.3 V. On the other hand, in Embodiment 4, these values of 1.0 V and 1.3 V were 2.0 V and 2.3 V, respectively (see S103B, S109B, and S105B in FIG. 13). This is because the pressure-sensitive resistance sensor 301B is used in Embodiment 4 but in this embodiment, the sheet switch 311B is used. This is also because when the pressure of not less than a certain value is applied onto the detection surface of the sheet switch 311B, irrespective of the magnitude of the pressure, the resistance value becomes almost zero ohm, and the substantially same voltage, i.e., 1.0 V in this case is outputted.

Further, in S509B, in the case where the CPU 40B discriminates that the A/D port input voltage value is not 1.3 V or more, then in S518B, the CPU 40B discriminates whether or not 3.0 sec or more of elapses as the timer value. In the case where the CPU 40B discriminates that 3.0 sec or more does not elapse, the sequence is returned to S509B. In the case where the CPU 40B discriminates that 3.0 sec or more elapses, in S521B, the CPU 40B discriminates that the sensor is abnormal and notifies the video controller 42 of the abnormality of the sensor.

Further, in S512B, in the case where the CPU 40B discriminates that the A/D port input voltage value is not 1.0 V or more, then in S519B, the CPU 40B discriminates whether or not 3.0 sec or more elapses as the timer value. In the case where the CPU 40B discriminates that 3.0 sec or more does not elapse, the sequence is returned to S512B. In the case where the CPU 40B discriminates that 3.0 sec or more elapses, in S521B, the CPU 40B discriminates that the sensor is abnormal and notifies the video controller 42 of the abnormality of the sensor.

Also in this embodiment, the remaining toner amount detection accuracy similar to that in Embodiment 1 is obtained. Further, even in the case where the pressure-sensitive resistance sensor 301B is used in place of the above-described sheet switch 311B, the temperature can be detected with timing when the reference polyester film 30B and the stirring polyester film 34B do not apply the pressure to the pressure-sensitive resistance sensor 301B. In this embodiment, commonality of the signal lines of the temperature detection of the process cartridge 4B and the signal lines of the sheet switch 311B can be achieved and therefore when compared with a constitution in which the signal lines are separately provided, the following effects are obtained. First, the number of the signal lines can be reduced by two lines and therefore the wires and connectors can be reduced. Further, the number of the A/D input ports of the CPU 40 can be reduced. Therefore, a cost can be reduced.

In this embodiment, as the temperature detecting sensor, the thermistor 41B was used. The thermistor used in this embodiment is of the type in which the resistance value is decreased with temperature rise but a thermistor of the type in which the resistance value is increased with temperature rise is also applicable.

Further, similarly as in Embodiments 6 and 7, the reference shaft 43B may also be used in place of the reference polyester film 30B.

According to this embodiment, the remaining toner amount can be detected in real time from the full state to the empty state of the toner, and even when the stirring member is operated at high speed, the remaining toner amount can be detected with high accuracy.

Other Embodiments

In Embodiment 4 to Embodiment 8, the embodiment in which the signal line of the reference potential is provided alone was described. However, the process cartridge 5B and the main assembly 101 are connected with each other so that the potential of the process cartridge 5B and the reference potential of the main assembly are the same potential and therefore commonality of the signal line of the reference potential and the reference potential of the pressure-sensitive resistance sensor 301B or the sheet switch 311B can also be achieved. As a result, one signal line can be reduced and therefore the wires and connectors can be reduced, so that a cost can be made low. Further, in Embodiment 4 to Embodiment 8, the example in which the pressure is converted into the voltage was shown. However, the pressure-sensitive resistance sensor 301B or the sheet switch 311B can also be replaced with other pressure sensors for converting the pressure into a current, a resistance value and a frequency. Further, in Embodiment 4 to Embodiment 8, for easy understanding, the reference to the table is made after the single detection, but when control such that the reference to associated tables is made after the data obtained by the measurement of plural times are averaged is effected, further improvement of the detection accuracy can be expected. Further, in Embodiment 4 to Embodiment 8, the example in which the developing unit has the integral structure was shown. However, also with respect to a supply type toner container provided separately from the developing roller, by providing the pressure sensor and the detection polyester film in the toner container, the present invention is applicable.

INDUSTRIAL APPLICABILITY

According to the present invention, the remaining amount of the toner can be detected in real time from the full state to the empty state of the toner, and even when the stirring member is operated at high speed, the remaining amount of the toner can be detected with high accuracy.

While the invention has been described with reference to the structures disclosed herein, it is not confined to the details set forth and this application is intended to cover such modifications or changes as may come within the purpose of the improvements or the scope of the following claims.

The invention claimed is:

1. An image forming apparatus comprising:

a developing unit for accommodating a developer;

a rotatable member, rotatable in said developing unit, for stirring the developer;

a pressure-detecting portion for detecting a pressure applied by said rotatable member and for outputting a voltage signal corresponding to the pressure, wherein said pressure-detecting portion is provided on a wall surface perpendicular to the rotational axis direction of said rotatable member in said developing unit; and a discriminating portion for discriminating an amount of the developer in said developing unit on the basis of a change in the voltage signal outputted from said pressure-detecting portion, wherein when the amount of the developer discriminated by said discriminating portion is not more than a predetermined amount, sensitivity of said pressure-detecting portion is switched.

2. An apparatus according to claim 1, wherein said pressure-detecting portion detects the pressure applied via the developer by the pressure-applying portion of said rotatable member.

3. An apparatus according to claim 1, further comprising a temperature detecting portion for detecting a temperature in said developing unit, wherein said temperature detecting portion is connected in parallel to said pressure-detecting portion.

4. An apparatus according to claim 1, wherein said pressure-detecting portion is a switch element which is placed in an on state or an off state depending on the pressure.

5. An apparatus according to claim 1, wherein said pressure-detecting portion is a pressure-sensitive element which is changed in resistance value depending on the pressure.

6. An apparatus according to claim 1, wherein said rotatable member is a member for stirring the developer in said developing unit.

7. An apparatus according to claim 1, wherein a reference potential of said pressure-detecting portion is the same as a reference potential of said developing unit.

8. An image forming apparatus comprising:

a developing unit for accommodating a developer;

a first rotatable member, having flexibility, for being rotated about a rotation shaft in the developing unit;

a second rotatable member, having flexibility different from the flexibility of said first rotatable member, for being rotated about a rotation shaft in the developing unit;

a pressure-detecting portion for detecting pressure applied by each of said first rotatable member and said second rotatable member, wherein said pressure-detecting portion is provided on a wall surface and outputs a first voltage signal depending on first pressure by said first rotatable member and a second voltage signal depending on second pressure by said second rotatable member; and a detecting portion for detecting an amount of the developer in said developing unit on the basis of one of i) a time difference between a first timing when the pressure applied by said first rotatable member is detected by said pressure-detecting portion and a second timing when the pressure applied by said second rotatable member is detected by said pressure-detecting portion, and ii) a pressure difference between the pressure which is applied by said first rotatable member and detected by said pressure-detecting portion and the pressure which is applied by said second rotatable member and detected by said pressure-detecting portion.

9. An apparatus according to claim 8, further comprising temperature detecting means for detecting a temperature in said image forming apparatus, wherein said temperature detecting means and said pressure-detecting portion are connected in parallel, and wherein said temperature detecting means detects the temperature is said image forming apparatus in a state in which said first rotatable member and said second rotatable member do not apply the pressure to said pressure-detecting portion.

10. An apparatus according to claim 8, wherein said first rotatable member is formed of a material having rigidity.

11. An apparatus according to claim 8, wherein said pressure-detecting portion is a pressure-sensitive element which is changed in resistance depending on the pressure.

12. An apparatus according to claim 8, wherein said pressure-detecting portion is a switch element whose output is turned on and off depending on the pressure.

13. An apparatus according to claim 8, wherein when an amount of the developer in the developing unit is not more than a predetermined amount, sensitivity of said pressure-detecting portion is switched.

14. An apparatus according to claim 8, wherein said first rotatable member or said second rotatable member stirs the developer in the developing unit.

* * * * *